United States Patent [19]

Ogasawara et al.

[11] 4,184,638

[45] Jan. 22, 1980

[54] LOW NOISE LEVEL, PRESSURE FLUID SPOUTING DEVICE

[75] Inventors: Takeo Ogasawara; Shunichi Doi, both of Nagoya, Japan

[73] Assignee: Kabushiki Kaisha Toyota Chuo Kenkyusho, Nagoya, Japan

[21] Appl. No.: 901,775

[22] Filed: May 1, 1978

[30] Foreign Application Priority Data

May 2, 1977 [JP] Japan ..... 52/50998

[51] Int. Cl.[2] ..... B05B 7/04; F01N 1/00

[52] U.S. Cl. ..... 239/418; 181/247; 181/259; 239/552; 239/589; 239/601

[58] Field of Search ..... 181/224, 247–251, 181/255, 259–263; 239/310, 318, 418, 433, 553, 553.3, 589–590.3, 601, 602, DIG. 21, DIG. 22, 552

[56] References Cited

U.S. PATENT DOCUMENTS

| | | | |
|---|---|---|---|
| 2,175,160 | 10/1939 | Zobel et al. | 239/589 |
| 3,982,605 | 9/1976 | Sneckenberger | 239/589 X |

*Primary Examiner*—Joseph E. Valenza
*Assistant Examiner*—Andres Kashnikow
*Attorney, Agent, or Firm*—Berman, Aisenberg & Platt

[57] ABSTRACT

A low noise level, pressure fluid spouting device includes an inlet for introducing a pressure fluid therein at one end thereof; a nozzle connected to the inlet for jetting or emitting the pressure fluid therefrom, the nozzle having an annular inner wall of a predetermined diameter as a nozzle port thereof with an enlarged portion at the other end thereof for spouting the pressure fluid from the nozzle. The enlarged portion has a predetermined length ($l_o$) from the entrance to the exit or open end thereof, and comprises an annular inner wall of a predetermined diameter ($d_2$) larger than that of the nozzle means as an enlarged passage communicating with the nozzle port; and an outer wall which is tapered or gradually decreased in width towards the exit or open end portion of the enlarged portion with a predetermined angle of inclination ($\theta$). The wall of the enlarged portion has a predetermined thickness (t) at the exit or open end portion of the enlarged portion. The dimensional relationship of the enlarged portion is characterized by the following optimum numerical value:

$$0.67 \leqq l_o/d_2 \leqq 1.875 \quad (1)$$

$$3° \leqq \theta \leqq 20° \quad (2)$$

$$0.42 \leqq t/d_2 \leqq 0.125 \quad (3)$$

In this manner, the present invention can suppress creation of screech and enlarge the range of low noise level.

47 Claims, 33 Drawing Figures

2a,2b
2e
2c,2d
2f,2g
110
100
90
80
70
noise level (dB)
0
1
2
3
4
5
6
supplied pressure of a pressure fluid (Kg/cm²)

3f
3c,3d
3a,3b
3e
110
100
90
80
70
noise level (dB)
0
1
2
3
4
5
6
supplied pressure of a pressure fluid (Kg/cm²)

6e,6f
6c
6d
6a,6b
Y3
110
100
90
80
70
noise level (dB)
0
1
2
3
4
5
6
supplied pressure of a pressure fluid (Kg/cm2)

7f
7e
7c,7d
7a,7b
110
100
90
80
70
noise level (dB)
0
1
2
3
4
5
6
supplied pressure of a pressure fluid (Kg/cm2)

LOW NOISE LEVEL, PRESSURE FLUID SPOUTING DEVICE

OBJECTS

A primary object of the present invention is to overcome shortcomings in the prior art devices.

Another object of the present invention is to provide a low noise level, pressure fluid spouting device which prevents production of screech and attains a wide range of low noise level.

Still another object of the present invention is to provide a low noise level, pressure fluid spouting device capable of simplifying the adjusting operation of the noise level.

Yet another object of the present invention is to remarkably improve the operational circumstances by supressing creation of screech and widening the low noise level range.

DETAILED DESCRIPTION OF THE INVENTION

This invention relates to a low noise level, pressure fluid spouting device adapted to spout or jet a pressure fluid.

Known prior art pressure fluid spouting or discharging devices are gas-nozzle-silencer devices, paint spraying devices, and the like. These prior art devices suffer from a high level noise, i.e., so called screech which exerts an adverse influence on operational circumstance. The aforenoted screech being a resonance sound of a high frequency which occurs in a specific range of the pressure fluid being supplied. In addition, the prior art devices suffer from a high level noise falling outside of the above-mentioned specific range of the pressure fluid being supplied. To cope with this, the prior art devices of this type include a silencer, sound-absorbing wall and the like for lowering the level of a noise therefrom. However, in such devices, the extent of a noise, which may be lowered, ranges between about 5 and 10 dB without the possibility of further improvements in lowering the noise level, thus failing to better the operational circumstances to a large extent. Furthermore, the prior art devices pose problems of complicated construction and large size, thereby leading to difficulties in attaching or locating same, with accompanying problems in adjustment and maintenance.

Figure 1:
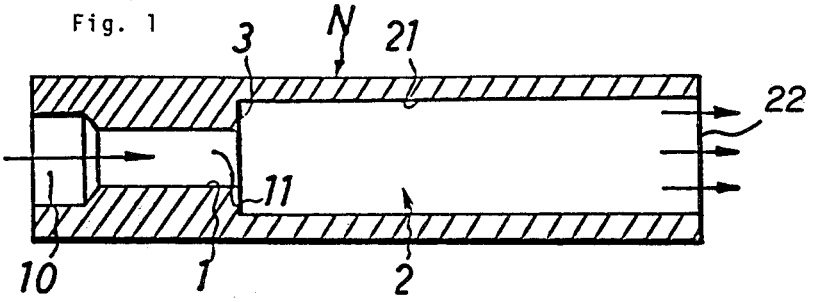
PRIOR ART Fig. 1
FIG. 1 is a view showing an outline of a prior art gas nozzle device.

More specifically, reference is made to FIG. 1 showing a prior art device. Such prior art device includes a gas nozzle portion N consisting of a nozzle 1 and an enlarged hollow portion 2 communicating with the nozzle 1. The portion 2 is a cylindrical passage 21 having a constant cross sectional area along its length from the exit end of the nozzle 1 to the exit end of the passage 21. As shown in FIG. 1, the gas nozzle portion N introduces a pressure fluid from its inlet portion 10 via a jet or exit 11 of the nozzle 1, into the passage 21, i.e., the enlarged hollow portion 2, and out of the exit end of passage 21, thereby providing a stream of fluid which may be used to blow accumulated particles off the surface of a body, such as dust, tips, or to blow off formed sheet metals, and the like. In this respect, the pressure fluid may be supplied thereto in a range of 1 to 6 kg/cm as a practical range and in a range of 1 to 10 kg/cm$^2$ as a critical range. As shown by the solid line I in FIG. 2, the gas nozzle N of the prior art device produces a lower level noise of a range of 89 to 91 dB, in the case of a limited range of the pressure, 3.2 to 4.1 kg/cm$^2$, of a pressure fluid spouting or emitting therefrom. In contrast thereto, in the range of pressures of a lower pressure level, which ranges from 2.0 to 3.2 kg/cm$^2$, there tends to be produced a noise of an extremely high level, which is referred to as a screech in a specific range of the aforenoted pressures. (See reference character A in FIG. 2). Furthermore, the prior art devices produce a noise of a high level falling outside of the aforenoted specific range of the pressure of a pressure fluid. More particularly, there is produced negative pressure at the location of the stepped portion 3 (FIG. 1) defined between the nozzle 1 and the enlarged hollow portion 2. This negative pressure causes air streams from nozzle 1 into the enlarged hollow portion 2 to cling to the inner surface of a wall of the passage 21 of the enlarged portion 2. However, in the prior art device, as the length $l_0$ of the enlarged portion 2 is long compared to the inner diameter $d_2$ of the enlarged portion, negative pressure at the inner wall of the enlarged portion is not high enough, i.e., near atmospheric pressure. As a result, the air streams fail to cling stably to the inner surface of the aforenoted wall, causing turbulence. Furthermore, as the prior art device has no tapered portion at the outlet side of the outer wall and no thin wall at the exit 22 of the enlarged portion, the angle of the flow direction of the exterior flow to the flow direction of the pressure flow from the enlarged portion is large, so that the fluctuation in velocity of the jet stream is large and turbulence is produced at the exit of the enlarged portion. This turbulence of air streams in turn acts as a vibration source and provides a resonance phenomenon, i.e., a screech of high noise level. Such an unstable phenomenon of fluid streams tends to take place in a range from the maximum to the minimum of a noise pattern as indicated by the solid line I in FIG. 2.

To lower noise level, it has been a general practice to equip prior art gas nozzle N with a pressure regulating means (not shown) adapted to adjust the pressure of a pressure fluid being supplied, so as to regulate such pressure to a limited range in order to achieve the level of noise which is free of the aforenoted screech. This leads to a complex regulating operation and a shortcoming in that, even if the pressure of a pressure fluid is properly regulated, once the pressure level of the fluid is varied, it becomes difficult to maintain the level of noise low, with a resulting tendency to produce a screech. Accordingly, the device must be increased in size and, hence, becomes further complicated to suppress the creation of a screech, thus failing to improve the operational circumstances to a desired extent.

It is, accordingly, an object of the present invention to provide a low noise level, pressure fluid spouting device which can avoid the aforenoted shortcomings in the prior art devices by suppressing the creation of a screech and enlarging a range of a low level noise, thereby widening the range of practical application.

According to a first aspect of the present invention, there is provided a low noise level, pressure fluid spouting device comprising inlet means for introducing a pressure fluid therein provided at one end portion of said device, nozzle means connected to said inlet means at one end thereof, for jetting the pressure fluid from the inlet means, said nozzle means having an annular inner wall of a predetermined diameter, said annular inner wall defining or forming a nozzle port communicating with said inlet means, enlarged means connected to the other end of said nozzle means and provided at the other end of said device, for spouting the pressure fluid from said nozzle means, said enlarged means having an annular inner wall of a predetermined distance ($d_2$) between the opposed inner walls larger than that of said nozzle means and a predetermined length ($l_0$) in the axial direction thereof, and a dimensional relationship of said enlarged means comprising $0.67 \leqq l_0/d_2 \leqq 1.875$, said annular inner wall comprising an enlarged passage communicating with said nozzle port of said nozzle means, whose exit is open to spout the pressure fluid, said enlarged means having an annular outer wall, whereby high negative pressure is produced at said inner wall of said enlarged means, the streams flowing out of said nozzle means steadily and stably cling to said inner wall of said enlarged means and spout from the exit of said enlarged means as strong and steady streams beyond said inner wall of said enlarged means to prevent turbulence at the exit of said enlarged means and the production of screech.

According to a second aspect of the present invention, the enlarged means has a tapered portion at an outlet side of said outer wall thereof, in which the outer diameter gradually decreases at a predetermined angle ($\theta$) to said inner wall of said enlarged means at an exit thereof, and a range of said predetermined angle of said tapered portion is as follows: $3° \leqq \theta \leqq 20°$, whereby the angle between the direction of the exterior flow and the direction of the interior pressure flow from the exit of said enlarged means is reduced by making the exterior flow follow said tapered portion to thereby reduce fluctuation in velocity of the spouted jet stream. As a result, the turbulence at the exit of said enlarged means, the gas-columnar-vibration based on said tubulence and the production of screech are prevented.

According to a third aspect of the present invention, an exit of said tapered portion of said enlarged means has a predetermined thickness (t) between said outer wall and said inner wall, and the dimensional relation of said thickness (t) of said tapered portion and the distance ($d_2$) between opposed points on the inner wall of said enlarged means is as follows: $0.042 \leqq t/d_2 \leqq 0.125$, whereby the amount of the exterior flow accompanied by the interior pressure flow is adjusted by the thickness (t) of said tip portion of said tapered portion and the mixing energy of the exterior flow and the pressure flow becomes small, and the production of screech is more effectively prevented.

Based on the following analysis of tests results, the inventors have determined the noted optimum numerical relationship, in which $l_0$ represents a predetermined length or distance from the entrance to the exit of the enlarged means as measured along its center axis, $d_2$ represents a predetermined diameter of an annular inner wall of the enlarged means or a predetermined distance between opposed points on the inner surfaces of the enlarged means as measured at a jet or exit of said nozzle means in cross section, $\theta$ represents a predetermined tapered angle or a predetermined angle of inclination defined by an outer peripheral surface and an inner peripheral surface of a wall of the enlarged means at the exit end thereof, and t represents a predetermined thickness of the wall of the enlarged means, as measured at an exit or open end portion thereof.

Figure 3:
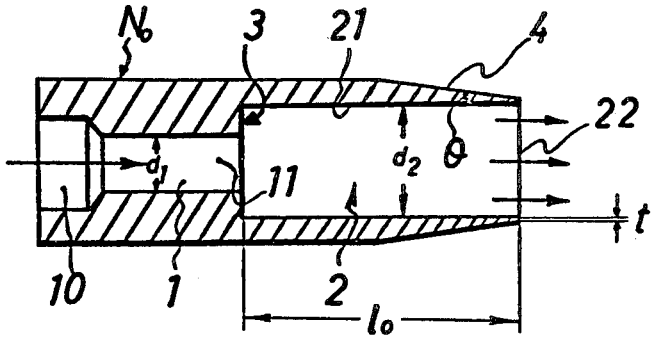
FIG. 3 is a sectional view of a nozzle type pressure fluid spouting device as one feature of the present invention, employed in our tests for the present invention.

More particularly, in the light of the aforenoted problems in the prior art devices, the inventors gave tests, repeatedly, to gas nozzle types of pressure fluid spouting devices to closely examine the creation of a screech and a noise-level-lowering effect, in terms of noise level range, followed by analysis. FIG. 3 shows a typical pressure fluid spouting device employed in our tests, while the results of the tests are shown in Table 1. As shown in FIG. 3, the pressure fluid spouting device $N_0$, which is one feature of the present invention and was employed in our tests for the present invention, comprises an inlet portion 10 as inlet means in the present invention at one end of the spouting device $N_0$ for introducing a pressurized fluid; a nozzle portion 1 as nozzle means in the present invention, connected in communication to the inlet portion 10; an enlarged portion 2 as enlarged means in the present invention, connected in communication to the nozzle portion 1 and provided at the other end of the device $N_0$. The enlarged portion 2 includes an enlarged hollow portion or passage 21 with an annular inner wall or an enlarged passage of the enlarged means in the present invention. One end of passage 21 communicates with the nozzle port 11 of the nozzle portion 1, and the other end is open to provide an exit to spout or emit the pressurized fluid. The enlarged hollow portion or passage 21 has a uniform cross-sectional area over the length thereof and a predetermined diameter ($d_2$) larger than that of the jet or exit of nozzle portion 1 which is a nozzle port of nozzle means in the present invention. Furthermore, the annular outer wall of the enlarged portion 2 has a tapered portion in the vicinity of the exit thereof with a predetermined angle of inclination ($\theta$) defined by the outer and inner walls of the enlarged portion 2, thereby providing a tapered outer peripheral portion 4. In these tests, there were used various combinations of: $l_0$ representing a predetermined length or distance from an entrance 3 to the exit 22 of the enlarged portion 2, as measured along the center axis of the enlarged portion 2; $d_2$ representing a predetermined diameter of an inner wall of the enlarged portion 2 or a predetermined distance between points on the opposed inner surfaces of the portion 2 as measured in its cross section; $\theta$ representing a predetermined tapered angle of the outer peripheral portion 4 or a predetermined angle of inclination defined by the inner wall and the outer wall of the enlarged portion 2; and t representing a predetermined thickness of the annular wall at the exit 22 of the enlarged portion 2, i.e., a predetermined thickness defined between an inner surface and an outer surface of the annular wall of the enlarged portion 2 at the exit thereof.

Meanwhile, symbols given in Table 1 denote the following:

$d_1$: a predetermined inner diameter (mm) of the nozzle portion 1 or a predetermined distance (mm) between the opposed inner surfaces of the wall, in cross section, of the nozzle portion 1 at the exit thereof to a pressure fluid discharge passage.

$d_2$: a predetermined inner diameter (mm) of the enlarged portion 2 or a predetermined distance (mm) between the opposed inner surfaces of the wall, in cross section, of the enlarged portion 2 at the exit of the nozzle portion 1 which is open to the former.

$l_0$: a predetermined length (mm) of the enlarged portion 2 or a predetermined distance (mm) from the entrance to the exit of the enlarged portion 2 having uniform cross-sectional area.

$\theta$: a predetermined angle of the tapered outer wall 4 or a predetermined angle of inclination of the outer wall at the tip or exit portion of the enlarged portion 2.

t: a predetermined thickness (mm) of the wall of the enlarged portion at the exit thereof.

In Table 1, nozzle Nos. (1) to (7) have different ratios of $d_2/d_1$, respectively, in which nozzle Nos. 1*a* to 1*n*, 2*a* to 2*g*, 3*a* to 3*f*, 4*a* to 4*i*, 5*a* to 5*g*, 6*a* to 6*f* and 7*a* to 7*f* belong to the groups of the nozzle Nos. (1) to (7), respectively, and also have different dimensions of $l_0$ (mm), $\theta$, t (mm). The test result of each nozzle No. having a different combination of $d_2/d_1$, $l_0$, $\theta$ and t is indicated with noise level (dB).

Figure 4:
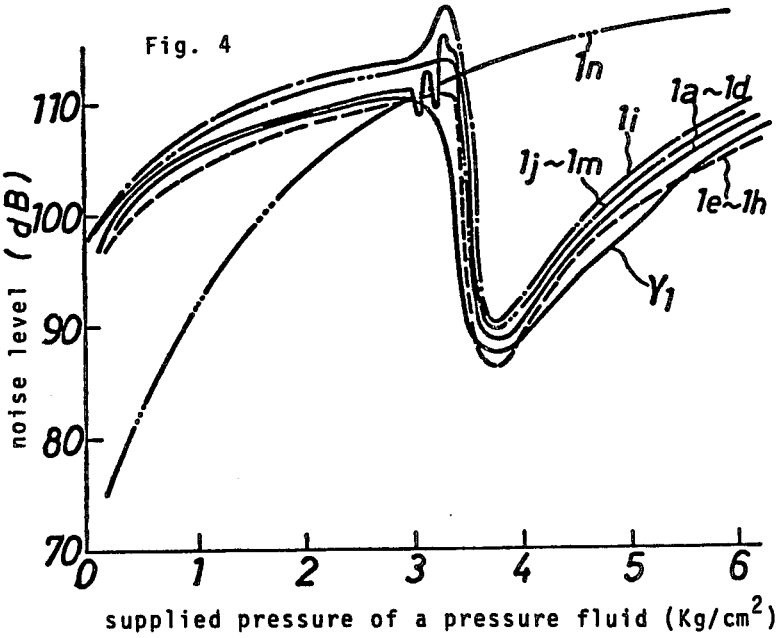
FIGS. 4 to 10 are graphs showing noise level curves representing nozzle Nos. (1) to (7), respectively, employed in our test of the present invention.
Figure 5:
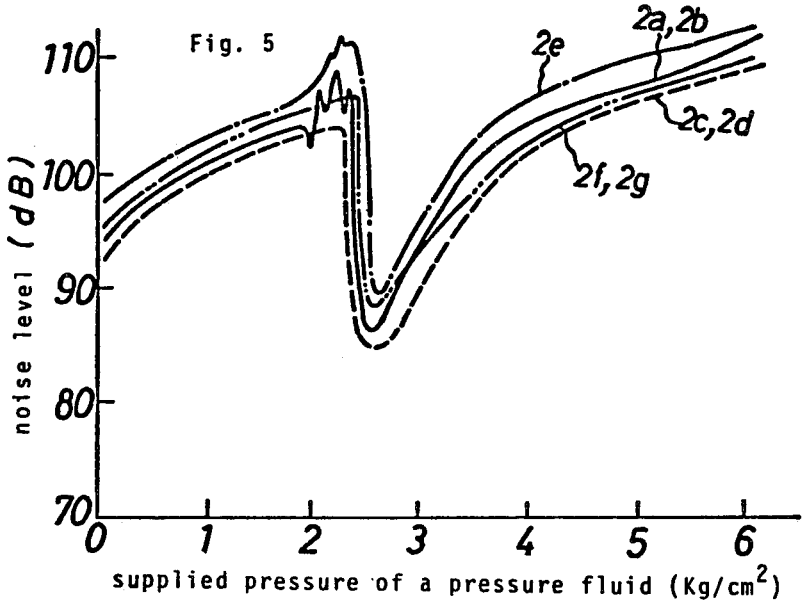
Figure 6:
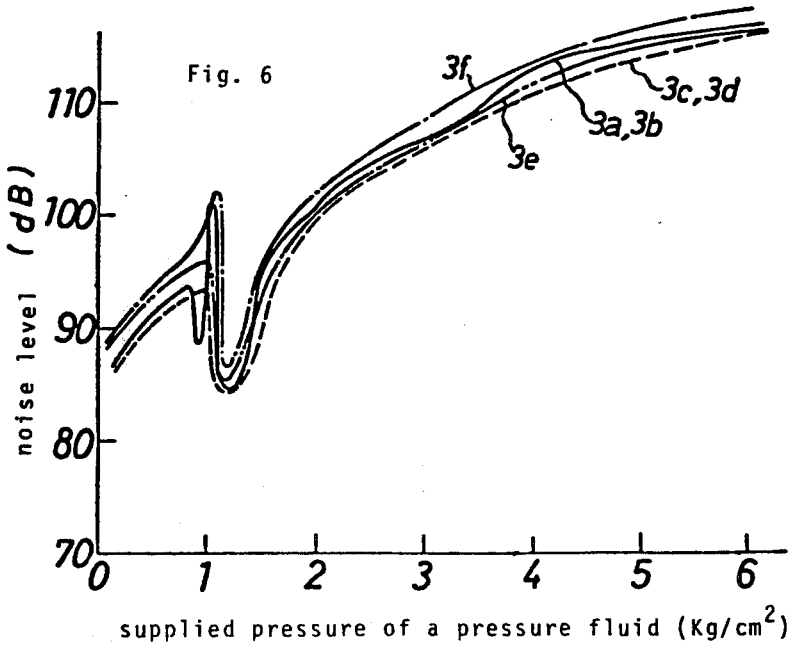
Figure 7:
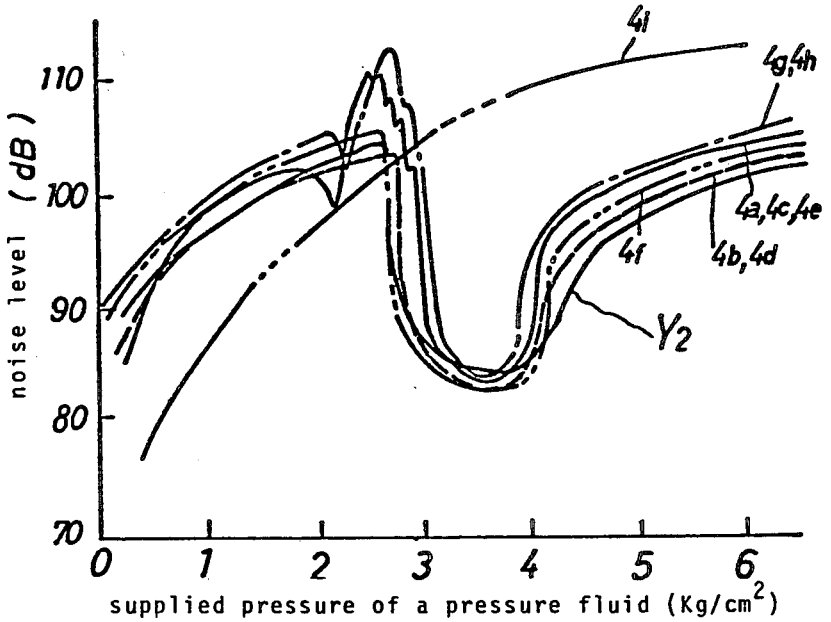
Figure 8:
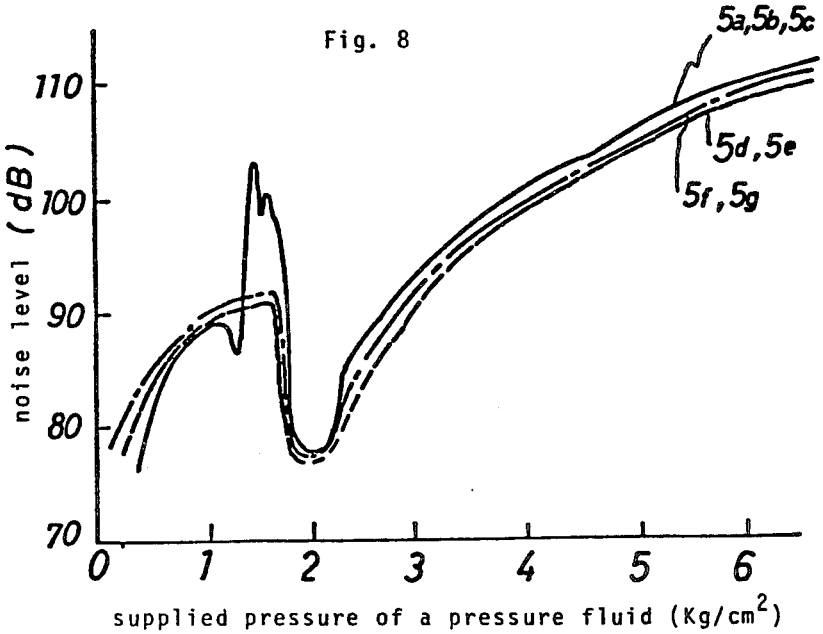
Figure 9:
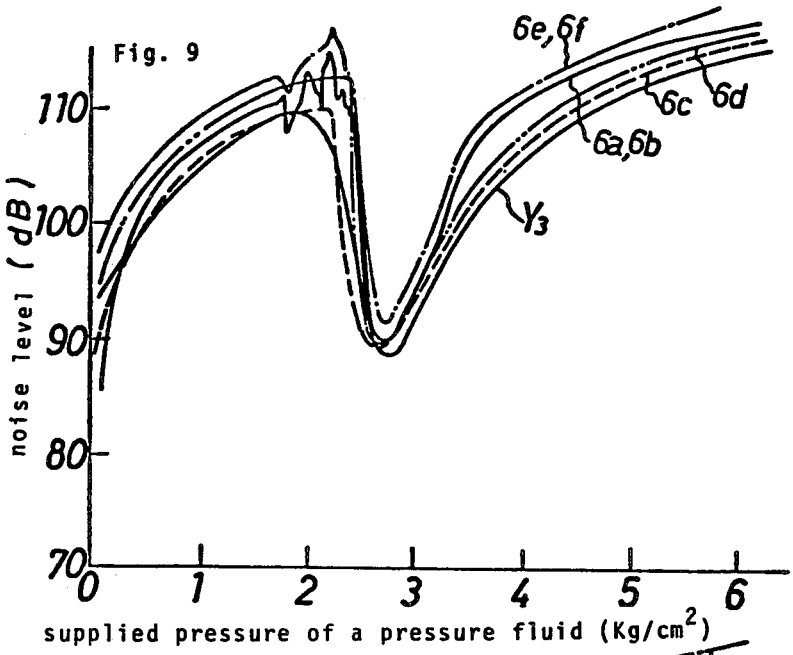
Figure 10:
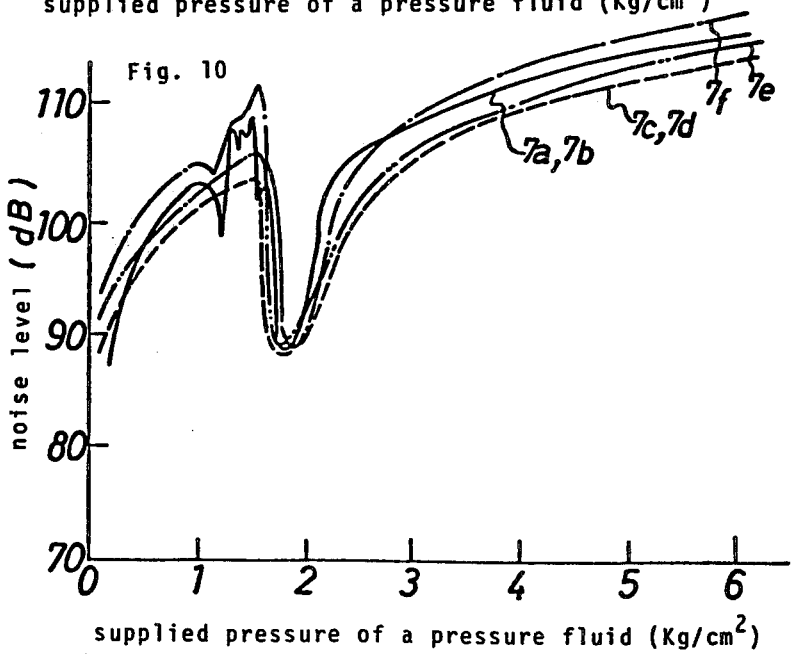

FIG. 4 to FIG. 10 show plotted graphs representing the test results of nozzle Nos. (1) to (7) wherein noise level curves representing the presence of a screech and range of a low noise level without screech can be seen. In particular, FIGS. 4 to 10 show noise level (dB) curves relative to pressure of a supplied pressure fluid ($Kg/cm^2$) and correspond to nozzle Nos. (1) to (7) of a gas nozzle type pressure fluid spouting device, as shown in Table 1, respectively. For example, FIG. 4 corresponds to nozzle Nos. (1) in Table 1 and reference numerals 1*a* to 1*n* in FIG. 4 show nozzle Nos. 1*a* to 1*n* belonging to the group of the nozzle No. (1). Similarly, FIGS. 5 to 10 correspond to nozzle Nos. (2) to (7), respectively, and in which figures reference numerals 2*a* to 2*g*, 3*a* to 3*f*, 4*a* to 4*i*, 5*a* to 5*g*, 6*a* to 6*f* and 7*a* to 7*f* show nozzle Nos. 2*a* to 2*g*, 3*a* to 3*f*, 4*a* to 4*i*, 5*a* to 5*g*, 6*a* to 6*f* and 7*a* to 7*f* shown in Table 1 respectively.

Table 1

| dimension nozzle No. | | $d_2/d_1$ | (mm) $l_0$ | (°) $\theta$ | (mm) t | noise (dB) screech | lowered level ($kg/cm^2$) of pressure supplied | minimum level ($kg/cm^2$) of pressure supplied |
|---|---|---|---|---|---|---|---|---|
| 1 | 1a | 12/6 | 30 | 8 | 0.5 | present | not more than 93 (3.55 ~ 4.25) | 88.5 (3.8) |
| | 1b | | 23 | 15 | 0.8 | present | not more than 93 (3.55 ~ 4.25) | 88.5 (3.8) |
| | 1c | | 21 | 21 | 0.4 | present | not more than 93 (3.55 ~ 4.25) | 88.5 (3.8) |
| | 1d | | 20 | 21 | 1.55 | present | not more than 93 (3.55 ~ 4.25) | 88.5 (3.8) |
| | 1e | | 20 | 20 | 0.5 | none | not more than 93 (3.5 ~ 4.3) | 86 (3.75) |
| | 1f | | 20 | 15 | 0.8 | none | not more than 93 (3.5 ~ 4.3) | 86 (3.75) |
| | 1g | | 20 | 10.5 | 1.0 | none | not more than 93 (3.5 ~ 4.3) | 86 (3.75) |
| | 1h | | 20 | 3 | 0.5 | none | not more than 93 (3.5 ~ 4.3) | 86 (3.75) |
| | 1i | | 20 | 2 | 0.4 | present | not more than 93 (3.65 ~ 4.05) | 90 (3.75) |
| | 1j | | 15 | 8 | 0.5 | none | not more than 93 (3.6 ~ 4.15) | 89.5 (3.8) |
| | 1k | | 10 | 15 | 0.8 | none | not more than 93 (3.6 ~ 4.15) | 89.5 (3.8) |
| | 1l | | 8 | 15 | 1.5 | none | not more than 93 (3.6 ~ 4.15) | 89.5 (3.8) |
| | 1m | | 8 | 10.5 | 0.6 | none | not more than 93 (3.6 ~ 4.15) | 89.5 (3.8) |
| | 1n | | 6 | 8 | 0.8 | | no low noise range | |
| 2 | 2a | 1/6 | 30 | 8 | 0.5 | present | not more than 93 (2.4 ~ 2.95) | 86.5 (2.55) |
| | 2b | | 21 | 8 | 0.5 | present | not more than 93 (2.4 ~ 2.95) | 86.5 (2.55) |
| | 2c | | 18 | 15 | 0.8 | none | not more than 93 (2.35 ~ 3.2) | 85 (2.6) |
| | 2d | | 15 | 6 | 0.5 | none | not more than 93 (2.35 ~ 3.2) | 85 (2.6) |
| | 2e | | 12 | 21 | 0.4 | present | not more than 93 (2.55 ~ 2.85) | 90 (2.6) |
| | 2f | | 12 | 18 | 1.2 | none | not more than 93 (2.45 ~ 2.95) | 88.5 (2.55) |

Table 1-continued

| dimension nozzle No. | | $d_2/d_1$ | (mm) $l_0$ | (°) $\theta$ | (mm) t | noise (dB) screech | lowered level (kg/cm²) of pressure supplied | minimum level (kg/cm²) of pressure supplied |
|---|---|---|---|---|---|---|---|---|
| | 2g | | 10 | 3 | 0.45 | none | not more than 93 (2.45 ~ 2.95) | 88.5 (2.55) |
| 3 | 3a | 8/6 | 21 | 15 | 0.5 | present | not more than 93 (1.1 ~ 1.45) | 84.5 (1.15) |
| | 3b | | 16 | 10.5 | 0.8 | present | not more than 93 (1.1 ~ 1.45) | 84.5 (1.15) |
| | 3c | | 15 | 8 | 0.5 | none | not more than 93 (1.05 ~ 1.6) | 84 (1.15) |
| | 3d | | 10 | 12 | 0.6 | none | not more than 93 (1.05 ~ 1.6) | 84 (1.15) |
| | 3e | | 8 | 8 | 0.8 | none | not more than 93 (1.05 ~ 1.5) | 85.5 (1.2) |
| | 3f | | 6 | 21 | 1.1 | present | not more than 93 (1.15 ~ 1.4) | 86.5 (1.2) |
| 4 | 4a | 8/4 | 21 | 10.5 | 0.8 | present | not more than 93 (3.05 ~ 4.1) | 83.5 (3.6) |
| | 4b | | 15 | 10.5 | 0.8 | none | not more than 93 (2.85 ~ 4.25) | 83 (3.65) |
| | 4c | | 15 | 2.5 | 1.05 | present | not more than 93 (3.05 ~ 4.1) | 83.5 (3.6) |
| | 4d | | 12. | 12 | 0.8 | none | not more than 93 (2.85 ~ 4.25) | 83 (3.65) |
| | 4e | | 12 | 2.5 | 1.05 | present | not more than 93 (3.05 ~ 4.1) | 83.5 (3.6) |
| | 4f | | 6 | 6 | 0.8 | none | not more than 93 (2.75 ~ 4.2) | 83 (3.5 ~ 3.7) |
| | 4g | | 6 | 2.5 | 0.32 | present | not more than 93 (3.2 ~ 4.0) | 84 (3.55) |
| | 4h | | 4 | 15 | 0.8 | present | not more than 93 (3.2 ~ 4.0) | 84 (3.55) |
| | 4i | | 3 | 15 | 1.0 | | no low noise range | |
| 5 | 5a | 6/4 | 15 | 18 | 0.8 | present | not more than 92 (1.75 ~ 2.8) | 77.5 (2.0) |
| | 5b | | 12 | 6 | 0.5 | present | not more than 92 (1.75 ~ 2.8) | 77.5 (2.0) |
| | 5c | | 10 | 20.5 | 0.8 | present | not more than 92 (1.75 ~ 2.8) | 77.5 (2.0) |
| | 5d | | 10 | 6 | 0.66 | none | not more than 92 (1.65 ~ 3.1) | 77 (1.95) |
| | 5e | | 8 | 16 | 0.66 | none | not more than 92 (1.65 ~ 3.1) | 77 (1.95) |
| | 5f | | 6 | 12 | 0.5 | none | not more than 92 (1.65 ~ 2.95) | 77.5 (1.9) |
| | 5g | | 4 | 5 | 0.5 | none | not more than 92 (1.65 ~ 2.95) | 77.5 (1.9) |
| 6 | 6a | 14/8 | 40 | 5 | 1.5 | present | not more than 93 (2.55 ~ 2.9) | 90 (2.7) |
| | 6b | | 30 | 15 | 1.2 | present | not more than 93 (2.55 ~ 2.9) | 90 (2.7) |
| | 6c | | 20 | 18 | 1.2 | none | not more than 93 (2.4 ~ 3.0) | 89.5 (2.65) |
| | 6d | | 15 | 5 | 0.85 | none | not more than 93 (2.5 ~ 2.95) | 89.5 (2.65) |
| | 6e | | 8 | 5 | 1.2 | present | not more than 93 (2.65 ~ 2.85) | 91.5 (2.7) |
| | 6f | | 8 | 10 | 0.7 | present | not more than 93 (2.65 ~ 2.85) | 91.5 (2.7) |
| 7 | 7a | 12/8 | 30 | 12.5 | 1.0 | present | not more than 93 (1.7 ~ 2.0) | 89 (1.8) |
| | 7b | | 25 | 12.5 | 1.3 | present | not more than 93 (1.7 ~ 2.0) | 89 (1.8) |
| | 7c | | 15 | 15 | 0.6 | none | not more than 93 (1.6 ~ 2.1) | 88.5 (1.75) |
| | 7d | | 10 | 20 | 1.45 | none | not more than 93 (1.6 ~ 2.1) | 88.5 (1.75) |
| | 7e | | 8 | 18 | 1.3 | none | not more than 93 (1.65 ~ 2.05) | 89 (1.75) |
| | 7f | | 6 | 19 | 1.45 | present | not more than 93 (1.7 ~ 2.05) | 89 (1.9) |

Figure 11:
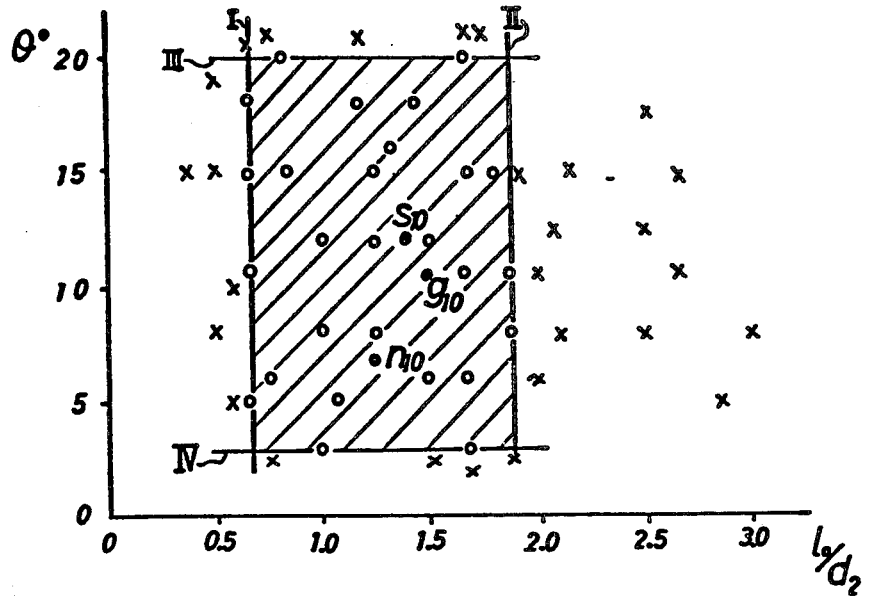
FIGS. 11 and 12 are graphs or plots representing distributions of points denoting the presence and absence of screeches in the devices referred to in FIGS. 3 to 10.

FIG. 11 shows a plot representing distributions of points denoting the presence and absence of screech based on results of tests of nozzle Nos. (1) to (7), in which an abscissa represents a ratio of a predetermined distance $d_2$ between the opposed inner surfaces of the enlarged portion 2, as measured in cross section at a jet or exit of the nozzle 1, which is open to the enlarged hollow portion 2, to a predetermined distance $l_0$ between the entrance 3 and the exit 22 of the enlarged hollow portion 2, as measured along the center axis of the enlarged hollow portion, while an ordinate represents a predetermined angle to inclination $\theta$ of a tapered outer peripheral end portion 4 of the enlarged hollow portion 2, and in which there are shown the presence (x) and absence (o) of a screech produced, and the boundaries between an acceptance area and a rejection area of the noise are shown by lines I, II, III, IV.

Figure 12:
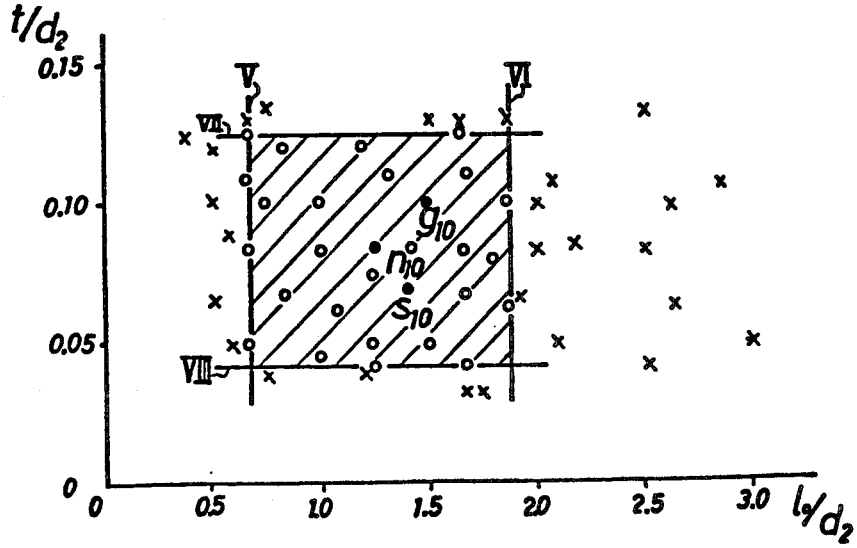

FIG. 12 shows a plot representing distribution of points denoting the presence and absence of screech based on the results of our tests given to the aforenoted nozzle Nos. (1) to (7), in which an abscissa represents a ratio of a predetermined distance $d_2$ between the opposed inner surfaces of the enlarged hollow portion 2, as measured at an exit of the nozzle 1 which is open to the enlarged hollow portion 2, to a predetermined distance $l_0$ between the entrance 3 and the exit 22 of the enlarged portion 2, as measured along the center line of the enlarged portion 2, while an ordinate represents a predetermined distance $d_2$ between the opposed inner surfaces of the enlarged hollow portion, as measured at an exit of the nozzle 1 which is open to the enlarged hollow portion 2, to a predetermined thickness t of the wall of the enlarged hollow portion 2, which is opened outside, in which there are shown the presence (x) and the absence (o) of a screech produced, the boundaries between an acceptance area and a rejection area of the noise being shown by lines V, VI, VII, VIII.

From the results of the aforenoted tests, the inventors discovered that the presence and absence of screech from the aforenoted gas nozzles as a pressure fluid spouting device depends on the predetermined distance $d_2$ between the opposed inner surfaces of the enlarged portion 2, as measured at an exit of the nozzle 1 which is open to the enlarged hollow portion or passage 21 of the enlarged portion 2, the predetermined distance $l_0$ between entrance 3 and exit 22 of enlarged portion 2, as measured along the center line of portion 2, the predetermined inclination $\theta$ of the tapered outer peripheral portion 4 of the enlarged portion 2, and predetermined thickness t of the wall of the enlarged portion 2 at the exit or open end thereof. In an attempt to provide a low noise level range, with freedom from screech in the aforenoted gas nozzle type pressure fluid spouting device $N_0$, the respective numerical values should fall in a broken-line range defined by a relationship $0.67 \leqq l_0/d_2 \leqq 1.875$ which is defined by lines I, II, a relationship $3 \leqq \theta < 20$ which is defined by the lines III, IV, as shown in FIG. 11, and also defined by a relationship $0.67 \leqq l_0/d_2 \leqq 1.875$ which is defined by lines V, VI, and a relationship $0.042 \leqq t/d_2 \leqq 0.125$ which is defined by lines VII, VIII, FIG. 12. As a result, screech could be eliminated and the range of the practical application can be widened by utilizing the aforenoted range of a low noise level, which could not have been achieved by prior art devices, so that our object, that is, noise-level-lowering effect, could be attained.

Figure 2:
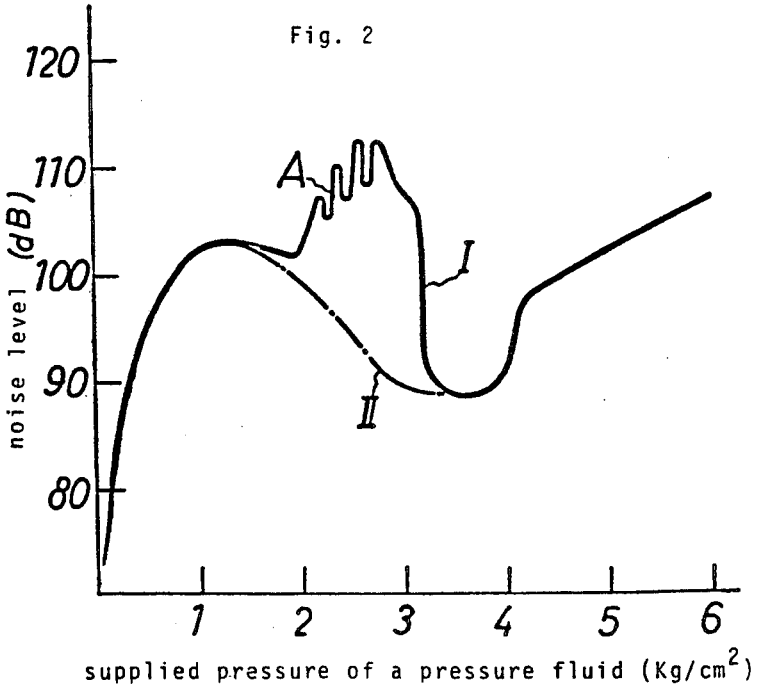
FIG. 2 is a graph showing noise level curves for comparing a noise level of the device of the present invention with that of prior art devices.

For instance, as shown by a dash-dot-dash line II in FIG. 2, there is not marked production of screech in the range of pressures from 1.5 to 3.5 kg/cm$^2$ of a supplied pressure fluid. This proves that the creation of screech can be completely prevented, and, as a result, such a range of low noise level may be desirably utilized.

Description will now be made regarding the presence and absence of screech in a gas nozzle type pressure fluid spouting device, in the respective nozzle Nos. (1) to (7), having the respective different ratios of $d_2/d_1$ given in Table 1 and FIGS. 4 to 10, in terms of the flowing condition of a pressure fluid.

The gas nozzles which produce screech are characterized by the phenomenon that streams flowing from the nozzle port 11 into passage 21 of the enlarged portion 2 cling to the wall of passage 21, due to negative pressure produced in the stepped portion 3*a* between the nozzle 1 and the enlarged hollow portion 2. Then, the streams clinging to the wall of the passage 21 are spouted out of the exit 22 of the enlarged portion 2. Stated differently, the streams which have been flowing along the wall of the passage 21 from the stepped portion 3*a* in a stable condition are abruptly deprived of a containing or restricting wall along which to flow at exit 22. It follows that marked turbulence of streams occurs at exit 22. The turbulence thus produced is propagated towards the upstream side of the streams, i.e., in the direction of the stepped portion 3*a*, thereby providing a gas-columnar-vibration source which depends on the distance $l_0$ between entrance 3 (or stepped portion 3*a*) and exit 22 as measured along the center axis of the enlarged portion 2. Accordingly, this device still fails to eliminate screech (resonance phenomenon), as in the case of prior art devices.

In contrast thereto, although the gas nozzles identified in Table 1 as being free of screech are also characterized by the phenomenon that streams flowing from the jet or exit of the nozzle port 11 into the enlarged passage 21 cling effectively to the wall of the passage 21 due to high negative pressure, i.e., near vacuum produced in the inner wall of the stepped portion 3*a* by selecting the dimension of $l_0/d_2$, there is no objectional turbulence at exit 22. Instead, steady streams flow out of the exit 22 despite the fact that streams, flowing in a stable condition along the wall of the enlarged passage 21 from the stepped portion 3*a*, are abruptly deprived of a containing or restricting wall along which to flow at exit 22 of the portion 2. As the angle between the direction of the exterior flow and the direction of the pressure flow is minimized by tapering or gradually decreasing the width of the outer wall of the enlarged portion 2 towards the exit 22 thereof with a predetermined angle $\theta$ and by making the outer wall of the exit of the enlarged portion 2 thin (thickness t), there is a smooth mixing of the pressure flow with the exterior stationary flow at the exit 22 with minimized turbulence of streams. This allows the pressure fluid to spout or be ejected from the nozzle device in a smooth, stable condition, thereby preventing the gas-columnar-vibration and eliminating screech.

Figure 13:
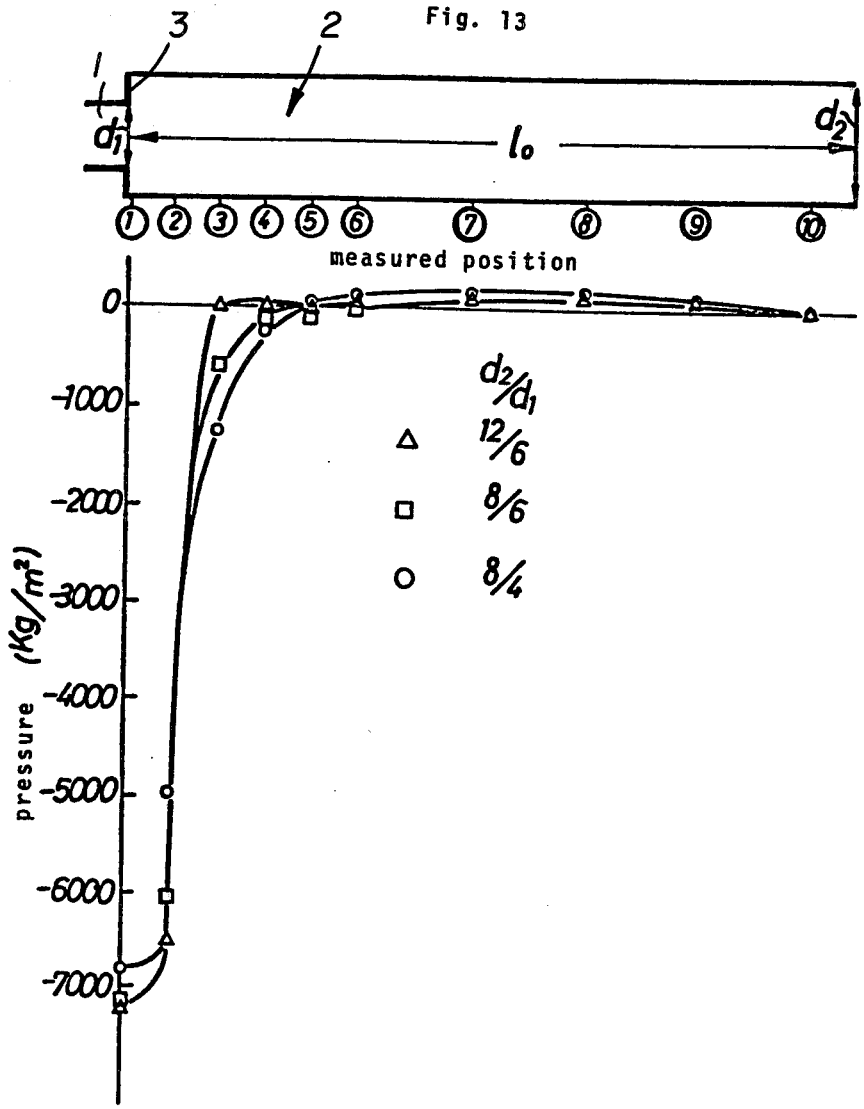
FIG. 13 is a graph or plot representing the pressure distribution in the pressure fluid spouting device according to the present invention.

Meanwhile, the flowing condition of the streams of a pressure flow is maintained constant in the passage 21 of the enlarged portion 2, when a screech is produced. This is well supported by the fact that the similar pressure distribution of a flow can be obtained along the inner surface of a wall of the enlarged portion 2, as shown in FIG. 13, even in the case of varying measured positions and varying ratios ($d_2/d_1$) of a predetermined distance $d_2$ (mm) between the opposed inner surfaces of a wall of the enlarged portion 2, measured at the exit of the nozzle portion 1 in cross section, to a predetermined distance $d_1$ (mm) between the opposed inner surfaces of a wall of the nozzle 1, measured at the exit of the nozzle port 11 of the nozzle portion 1 in its cross-section.

Figure 14:
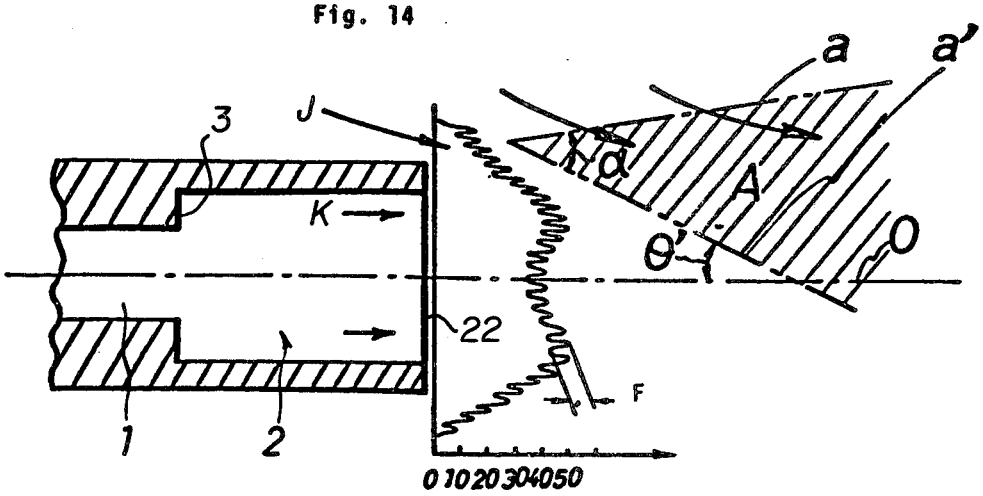
PRIOR ART Fig. 14
FIGS. 14 and 15 are views showing diagramatically and graphically the velocity distributions of the jet streams from pressure fluid spouting devices according to the prior art and the present invention, respectively.

In the case of prior art nozzles, shown in FIG. 14, the angle of direction of the exterior flow J with respect to the direction of the pressure flow K is large, and this results in vigorous mixing of the pressure flo K with exterior stationary flow J at the exit 22 of the enlarged portion 2. Consequently, the velocity of the jet streams fluctuates to a large extent as indicated by F in FIG. 4. In contrast thereto, as described above in the case of a pressure fluid spouting device according to the present invention, which is referred to in FIG. 15, the angle is small due to the tapered wall portion and the thin tip of the enlarged portion 2. This produces the highly desirable smooth mixing of pressure fluid (flow) K with exterior stationary flow J at the exit 22 of the enlarged portion, thereby minimizing the fluctuation in velocity of the jet streams.

The low noise level, pressure fluid spouting device of the present invention can suppress the production of a screech by utilizing a low noise level range. Range of optimum numerical values for the respective constituting elements or means of a pressure spouting device according to the present invention can be summarized and proved by the following tests:

$$0.67 \leqq l_0/d_2 \leqq 1.875 \quad (1)$$

$$3 \leqq \theta \leqq 20 \quad (2)$$

$$0.042 \leqq t/d_2 \leqq 0.125 \quad (3)$$

In short, as the present invention produces higher negative pressure at the entrance 3 of the enlarged portion or means 2 than that in the prior art nozzles, by selecting a predetermined ratio $l_0/d_2$, the streams flowing out of the nozzle means steadily and stably cling to the annular inner wall of the enlarged means and are spouted or emitted from the exit 22 of said enlarged means as strong and steady streams beyond the annular wall of the enlarged means 2.

Furthermore, as the present invention minimizes the angle between the exterior flow direction and the pressure flow direction at the exit of the enlarged means by selecting a predetermined tapered angle ($\theta$) of the tapered wall portion of the enlarged means and a predetermined thickness (t) at the exit portion of the tapered portion, the fluctuation F in velocity of the jet stream is small. The present invention prevents turbulence at the exit of the enlarged means, gas-columnar-vibration based on this turbulence and the production of screech over a wide range.

With the aforenoted device of the present invention, the respective constituting elements or means provide an optimum range of numerical values of $l_0/d_2$, $\theta$ and $t/d_2$, so that by selecting a suitable combination of these ranges of numerical values, the production of a screech can be suppressed and a range of a low noise level can be widened, commensurate with the object of this invention.

Also, a pressure fluid spouting device according to the present invention can be modified in its size, its configuration and the like in the above range of the optimum numerical values according to the object of its use and, hence, allow a wide application as well as simple adjustment is lowering the noise level, so that the device may be reduced in size, easy to manufacture, and low in cost.

The low noise level, pressure fluid spouting device according to the present invention will now be described in more detail with reference to the following embodiments in which the device is applied to air spray means, exhaust sound silencer means and a paint spraying means.

Figure 16:
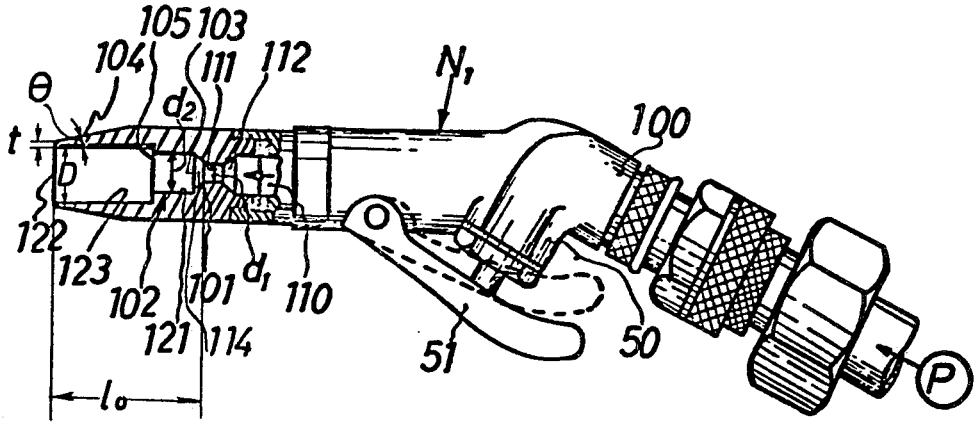
FIGS. 16 and 18 are views representing the outlines of an air spraying means according to a first embodiment of the invention.
Figure 17:
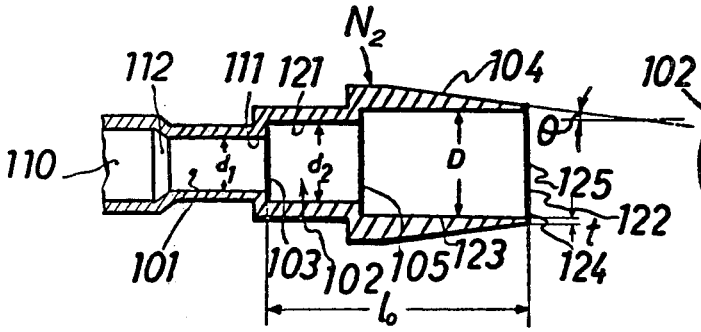
Figure 18:
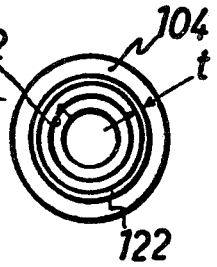

FIGS. 16, 17 and 18 show an air spray means according to a first embodiment of the present invention. Gas nozzles $N_1$ and $N_2$ of the air spray means according to the first embodiment is designed to blow away accumulated materials or members off the surface of a body by means of a pressure fluid, i.e., a fluid under pressure.

The gas nozzle $N_1$ of the air spray means according to the first embodiment as shown in FIG. 16 comprises a pressure flow introducing pipe 100 and a hollow cylinder having an outer wall of a constant diameter and an inner wall having different diameters, which hollow cylinder includes an inlet portion 110 at one open end portion thereof connected to the pipe 100, a nozzle portion 101 connected to the inlet portion 110, and an enlarged portion 102 at the other open end portion thereof, connected to the nozzle portion 101. The inlet portion 110 communicates with a pressure flow source P at one end (an upstream end) through the pressure flow introducing pipe 100. The nozzle portion 101 comprises an inlet, tapered, inner wall 112 of the hollow cylinder connected to the inlet portion 110, a throttled inner wall having a reduced predetermined diameter ($d_1$) of the hollow cylinder connected to the inlet tapered inner wall 112, and an outlet tapered inner wall 114 of the hollow cylinder connected to the throttled inner wall. The enlarged portion 102 comprises a first inner wall of the hollow cylinder forming an enlarged hollow portion or passage 121 of the enlarged portion 102 and having a predetermined constant distance or diameter ($d_2$) connected to said outlet tapered inner wall 114; a second inner wall of the hollow cylinder, having a predetermined constant distance or diameter (D) larger than ($d_2$) the first inner wall, connected to the first inner wall by a stepped bottom portion thereof, which second inner wall forms a further enlarged guide passage 123 of the enlarged means; and a straight tapered portion 104 provided at the exterior side of the outer wall of the hollow cylinder. The outer diameter of the tapered portion 104 is gradually and straightly decreased towards exit 122 of the enlarged portion 102 with a predetermined angle of inclination ($\theta$). The tapered portion 104 has a predetermined thickness (t) at the exit of the enlarged portion 102. Also, the enlarged portion 102 has a predetermined length or distance ($l_0$) from the exit 122 to an entrance 103 of the enlarged portion 102; i.e., from the exit of the further enlarged guide passage 123 to the entrance of the enlarged passage 121. The predetermined diameter ($d_2$) of the enlarged passage 121 is defined by the opposed surfaces of a constant cross-section area thereof. The entrance 103 of the enlarged portion 102 is open to the nozzle port 111 of the nozzle portion 101 and the exit 122 thereof is open to spout or emit the pressure flow, such as air. This structure facilitates the mixing of a pressure fluid from the nozzle $N_1$ with an exterior stationary flow.

In addition, in the gas nozzle $N_1$ of the air spray means according to the first embodiment (FIG. 16), a pressure fluid supply interruption changeover valve means 50 is provided in the pipe 100 between the inlet portion 110 and the pressure fluid supply source P. The wall of portion 110 is threaded to engage a threaded end portion of pipe 100. The valve means 50 (not shown in detail) is designed to interrupt the supply of a pressure fluid, when a lever 51 is brought to the solid-line position, and to allow the supply of a pressure fluid when the lever 51 is maintained in a broken-line position. An example of the embodiment of FIG. 16 follows. The distance $d_2$ between the opposed inner surfaces of a wall of the enlarged hollow portion or enlarged passage 121 in the enlarged portion 102, as measured at the exit of the passage 121, is 12 mm. The diameter $d_1$ of the throttled port of the nozzle 101, as measured at the jet or exit of the nozzle port 111 communicating with the enlarged passage 121, is 6 mm. The distance (length) $l_0$ between the entrance 103 and exit 122 of the enlarged portion 102 as measured axially along the center line thereof is 15 mm. The distance D between the opposed inner surfaces of a wall of the more enlarged guide passage 123, as measured at the exit 122 thereof, is 12 mm. The predetermined angle of inclination $\theta$ of the tapered portion 104 of the outer wall is 6°. The predetermined thickness t of the wall at exit 122 of the enlarged portion 102 is 1.0 mm.

The gas nozzle of this first embodiment provides the relationship of $l_0/d_2=1.25$, $\theta=6°$, $t/d_2=0.083$. This relationship is designated by a symbol n10 in the hatched portions of FIGS. 11 and 12 defined by lines I, II, III, IV and V, VI, VII, VIII, respectively, and the level of a fluid pressure supplied from the inlet portion 110 falls in a range of 1 to 9 kg/cm$^2$.

In operation of the gas nozzle of the first embodiment having the aforenoted arrangement, when the lever 51 in the changeover valve means 50 is operated, the passage between the pressure fluid supply source P and the inlet portion 110 is open, thereby allowing the pressure fluid to flow into the tapered portion 112 and the throttled nozzle port 111 of the nozzle portion 101. A pressure flow such as air is spouted through the nozzle port 111 and the tapered portion 116 of the nozzle 101 into the enlarged passage 121 of the enlarged portion 102, and then out through the exit 122 of the more enlarged guide passage 123 of the enlarged portion. Thus, accumulated material or a member may be blown off a body by the pressure fluid (flow) such as air thus spouted. In this case, as the ratio of the length ($l_0$) to the diameter ($d_2$) is selected as described above, the flow from the nozzle port 111 of the nozzle portion 101 into the enlarged hollow portion or enlarged passage 121 stably cling to the inner surface of the passage 121 due to high negative pressure produced at the connecting portion defined by the nozzle portion 101 and enlarged hollow portion or passage 121. Then, the aforenoted air flow may run in a stable and smooth condition along the inner surfaces of passages 121, 123, without separating therefrom.

Figure 15:
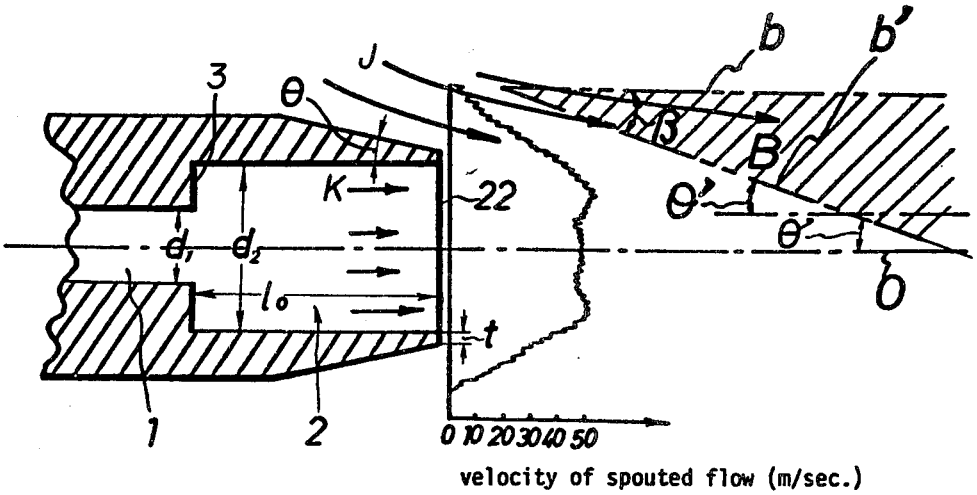
Figure 19:
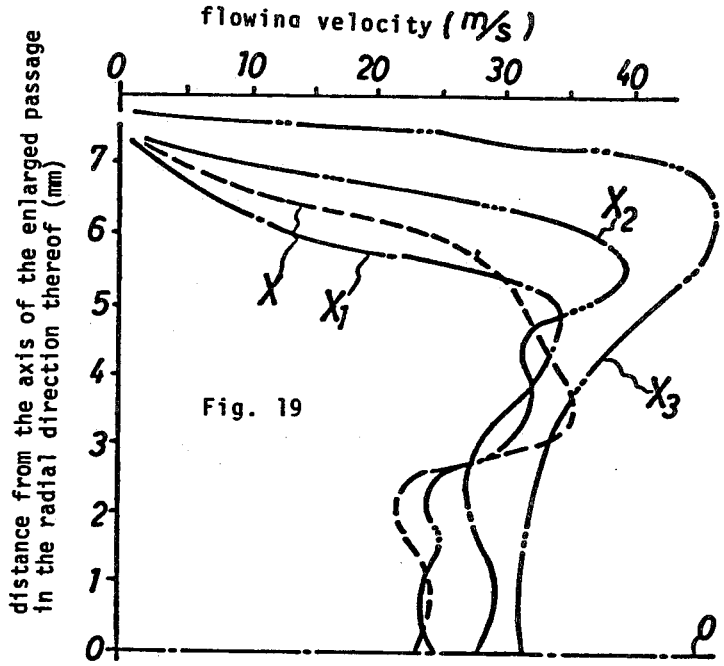
FIG. 19 is a graph showing the pressure distributions in respective embodiments of the invention.

Accordingly, velocity of a pressure flow being spouted outside from a central portion 125 of the exit 122 is lower than the velocity of a pressure flow prevailing in a circumferential portion 124 of the exit 122, thereby exhibiting velocity distribution represented by a long and short dash line $X_1$ in FIG. 19. More particularly, with the gas nozzle $N_1$ of the first embodiment, the flow resistance of a pressure fluid (flow) is reduced by means of the tapered configuration of the outer peripheral portion 104 of the enlarged portion 102, as well as due to a predetermined thickness (t) of the wall at the exit of the enlarged portion 102, so that the velocity of a pressure flow around the circumferential portion 124 is higher and stronger than that of a flow running in the central portion 125 at the exit 122. As shown by the velocity distribution of a pressure flow in the gas nozzle $N_1$ of the first embodiment, the direction of the pressure flow being spouted is maintained in parallel with the opposed inner surfaces of a wall of the further enlarged guide passage 123 outside of the exit 122 as viewed in cross section as shown by the long and short dash line $X_1$ in FIG. 19. Further, as the thickness t of the exit wall of the enlarged portion is selected as described above, the amount of exterior flow accompanied by the pressure flow is adjusted, so that the mixing energy of the exterior flow to the pressure flow spouted from the exit 122 of the enlarged portion becomes small. As a result, as shown in FIG. 15, there is provided a very narrow mixing range B of the pressure flow with exterior stationary air in the axial direction of a nozzle $N_1$ at the exit 122 thereof, so that there is defined an angle $\theta'$, which is relatively small, between one surface b' of the mixing range B and an axial line 0 of the nozzle $N_1$ in which range B the pressure flow is smoothly mixed with the weak exterior stationary flow. Accordingly, because of a reduced difference in velocity of jet flows between the central portion 125 and the circumferential portion 124, there results no marked production of a vortex, turbulence, peeling or the like of flows due to the impingement of the pressure flow on the stationary flow, so that both flows may be mixed with each other in a stable and smooth condition, thereby lowering the level of noise. Furthermore, the velocity of a pressure flow in the direction perpendicular to the axial direction of the exit 122 is increased and the flow is spouted from the exit in the direction parallel with the axis of the exit or opening, so that the jet flow around the circumferential portion 124 of the nozzle at the exit 122 affords a sort of shielding effect, thereby minimizing the creation of a vortex, turbulence or peeling of flows upon mixing of a pressure flow with stationary air in this position, thereby lowering the level of noise. For this reason, a noise curve for the gas nozzle $N_1$ of the first embodiment relative to the pressure supplied is represented by a symbol $Y_1$ in FIG. 4, so that the noise level may be lowered to 20 dB with freedom from screech. In addition, despite some variation in pressure supplied, the noise level in a low noise level range may be maintained stable and smooth, with the accompanying improved practical advantages.

FIG. 17 shows a gas nozzle $N_2$ which is a modification of the gas nozzle $N_1$ of the first embodiment shown in FIG. 16, and FIG. 18 is an end view thereof. Such a modified gas nozzle $N_2$ of the air spray means according to the first embodiment comprises a stepped hollow cylinder including an inlet portion 110; a nozzle portion 101 having an annular inner wall of a predetermined diameter $d_1$ smaller than that of the inlet portion 110, connected to the inlet portion 110 at one end thereof; and an enlarged portion 102 connected to the nozzle portion 101 at one end thereof. The enlarged portion 102 is provided with a first inner wall of a uniform cross-sectional area having a predetermined diameter $d_2$ larger than $d_1$, which defines an enlarged hollow portion or passage 121; a second inner wall of a uniform cross-sectional area having a predetermined diameter D larger than $d_2$, which defines a further enlarged guide passage 123; and an outer wall having a first outer wall of a predetermined outer diameter larger than that of the nozzle portion 101, and a second outer wall of a predetermined outer diameter larger than that of the first outer wall, the second outer wall having a portion 104 tapered or gradually decreased towards the exit 122 of the enlarged portion 102 with a predetermined angle of inclination $\theta$ and also having a predetermined thickness t at the exit 122 thereof. The enlarged portion 102 has a predetermined length $l_0$ from the exit 122 to the entrance 103 of the enlarged portion 102.

The description of embodiments to be described hereinafter will relate particularly to the differences between the first and the following embodiments, like parts being designated with like reference numerals or symbols and, hence, detailed descriptions thereof will be omitted.

Figure 20:
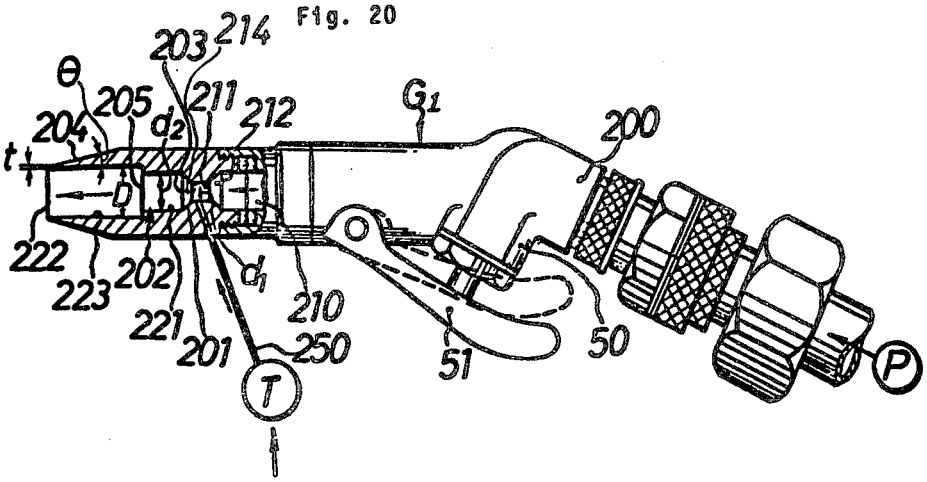
FIGS. 20 to 22 are views showing outlines of a paint spraying means according to a second embodiment of the invention.
Figure 21:
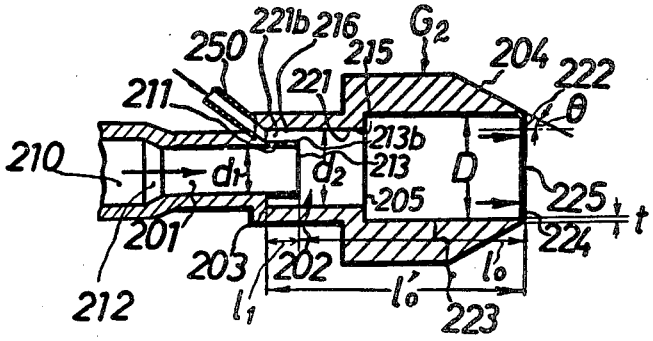
Figure 22:
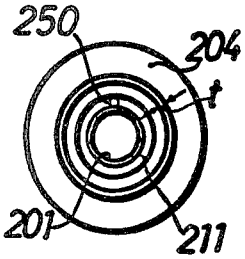

As shown in FIGS. 20 to 22, a paint spraying means according to a second embodiment of the present invention serves to spray liquid paint in the form of atomized particles onto the surface of a member, or material, with the aid of a pressure fluid (flow). The paint spraying means G, as shown in FIG. 20 comprises a pressure flow introducing pipe 200 and a hollow cylinder having an outer wall of a constant diameter and an inner wall having different diameters, which hollow cylinder includes an inlet portion 210 at one open end thereof and connected to the pipe 200, a nozzle portion 201 connected to the inlet portion 210, and an enlarged portion 202 at the other open end thereof, connected to the nozzle portion 201. The inlet portion 210 communicates with a pressure flow source P at one end (an upstream end) through the pressure flow introducing pipe 200, and is connected thereto in the manner of gas nozzle $N_1$. The nozzle portion 201 comprises an inlet tapered inner wall 212 of the hollow cylinder, connected to the inlet portion 210, a throttled inner wall 211 of the hollow cylinder having a reduced predetermined diameter $d_1$ and connected to the inlet tapered inner wall 212, and an outlet tapered inner wall 214 of the hollow cylinder connected to the throttled inner wall. The enlarged portion 202 comprises a first inner wall of the hollow cylinder forming an enlarged hollow portion or passage 221 of the enlarged portion 202, having a predetermined constant diameter $d_2$ and connected to said outlet tapered inner wall 214 of the nozzle portion 201; a second inner wall of the hollow cylinder having a predetermined constant diameter D larger than that of the first inner wall, connected to the first inner wall by a stepped bottom portion thereof, which second inner wall forms a further enlarged guide passage 223 of the enlarged means; and a straight tapered portion 204 provided at the outlet side of the outer wall of the hollow cylinder. The outer diameter of the tapered portion 204 is gradually and straightly decreased towards an exit 222 of the enlarged portion 202 with a predetermined angle of inclination ($\theta$). The tapered portion 204 has a predetermined thickness (t) at the exit of the enlarged portion 202. Also, the enlarged portion 202 has a predetermined length or distance ($l_0$) from the exit 222 to an entrance 203 of the enlarged portion 202, i.e., from the exit of the further enlarged guide passage 223 to an entrance of the enlarged passage 221. The predetermined diameter ($d_2$) of the enlarged passage 221 through the outlet tapered portion 214 is defined by the opposed surfaces of a constant cross-section area thereof. The entrance 203 of the enlarged portion 202 is open to the nozzle port 211 of the nozzle portion 201 and the exit thereof is open out of the paint spraying means $G_1$ to spout or emit the pressure flow. The throttled inner wall of the nozzle portion 201 is provided with an open passage which communicates with a liquid paint supply source T through a conduit 250. The enlarged passage 221 communicates with the further enlarged guide passage 223 of a uniform cross-sectional area, so that a mixture of a pressure fluid and the paint may be spouted out of the exit 222 of the passage 223. Still furthermore, a paint spraying means $G_1$ according to the second embodiment is provided with a supply-interruption changeover valve means 50 within the introducing pipe 200 between the inlet portion 210 and pressure fluid supply source P. The valve means 50 (not shown in detail) is designed to interrupt the fluid supply when a lever 51 is brought to the solid-line position, and permits the flow of the fluid supply when the lever 51 is maintained in the broken-line position. In the paint spraying means according to the second embodiment the distance ($d_2$) between the opposed inner wall surfaces of the enlarged passage 221 at the exit 215 thereof, as viewed in cross-section, is 8 mm. The distance ($d_1$) between the opposed inner surfaces of the wall of the nozzle portion 201 as viewed in cross-section at the exit thereof is 4 mm. The distance ($l_0$) between the entrance 203 to the exit 222 of the enlarged portion 202, as measured along the center line of the portion 202, is 10 mm. The distance (D) between the opposed inner surfaces of the further enlarged passage 223 as measured in its cross-section at the exit 222 is 8 mm. The tip inclination angle ($\theta$) of the end portion 204 is 10° and the thickness t of the outer peripheral portion 204 at the exit 222 is 0.8 mm. In addition, the pressure of a fluid being supplied through the inlet portion 210 falls in a range of 1 to 4 kg/cm$^2$.

The dimensional relationship of the paint spraying means G of the second embodiment is maintained as follows:

$$l_0/d_2=1.5;\ \theta=10°;\ t/d_2=0.10,$$

in ranges defined by I, II, III, IV, and V, VI, VII, VIII in FIGS. 11 and 12, respectively, at the symbol $g_{10}$.

As shown in FIG. 20, a changeover valve means 50 for supplying and interrupting a pressure flow is provided to the pressure flow introducing pipe 200 between the inlet portion 210 and the pressure fluid supply source P.

With the second embodiment having the aforenoted arrangement, a passage from the pressure fluid supply source P to the inlet portion 210 is opened by operating lever 51 in the changeover valve means 50 to supply a pressure fluid to the nozzle portion 201 and then into the enlarged portion 202. The pressure fluid or flow thus supplied is spouted from the jet of the nozzle port 211 of the nozzle portion 201 into passage 221, so that a liquid paint is supplied under suction from the liquid supply passage 250, and atomized into minute particles. The resulting mixture fluid is introduced into the further enlarged guide passage 223 to be spouted or emitted through the exit 222 of the passage 223 outside. Accordingly, a liquid paint may be positively atomized by a pressure fluid being thus spouted to be sprayed over the surface of a body to be coated with high accuracy at high efficiency. With further respect to the second embodiment G, streams flowing from the nozzle portion 201 into the enlarged hollow portion 221 cling to the inner surface of a wall of the enlarged linear passage 221 due to negative pressure created at the stepped portion between the nozzle portion 201 and the enlarged hollow portion 221. Thus, the aforenoted streams may run in a stable and smooth condition without being peeled from the inner surface of a wall of the enlarged linear passage 221.

High negative pressure at the entrance of the enlarged portion 202 of this second embodiment is produced by selecting a predetermined ratio $l_0/d_2$ of the length $l_0$ to the diameter $d_2$ of the inner wall of the enlarged portion 202 so that the streams flowing out of the nozzle means steadily and stably cling to the annular wall of the enlarged portion 202 and are spouted or emitted from the exit of the enlarged portion 202 as strong and steady streams beyond the annular wall of the enlarged portion 202. As a result, the velocity of a pressure flow being spouted through the exit 222 in the central portion 225 at the exit 222 is lower than the velocity of the fluid adjacent the circumferential portion 224 of the exit 222, thereby exhibiting a velocity distribution such as shown by line $X_2$ in FIG. 19. More particularly, because the circumferential portion 224 of the exit 222 has a predetermined thickness (t) and the end portion 104 has a tapered converging shape, the flow resistance of a mixture fluid may be lowered, with the result that the velocity of a mixture fluid around the circumferential portion 224 is higher than that of a fluid in the central portion 225 at the exit 222. As shown by the velocity distribution of the second embodiment G, in FIG. 19, the direction of a mixture fluid being spouted is maintained in parallel with the axial direction between the opposed inner wall surfaces of the passage 223 of the enlarged portion 202. This is best shown by the line $X_2$ in FIG. 19. For this reason, as shown in FIG. 15, the angle of direction of the exterior flow to the direction of the pressure flow from the exit 222 of the enlarged portion 202 of embodiment G is minimized by selecting a predetermined angle ($\theta$) of the tapered portion of the enlarged portion and a predetermined thickness (t) at the exit portion of the enlarged portion. Hence, the fluctuation F in velocity of the jet stream is small. Further, this prevents turbulence at the exit of the enlarged portion, gas-columnar-vibration based on turbulence, and the production of the screech over wide range. With more particularity, a mixing range B of a mixture fluid with an exterior stationary flow is narrower, as compared with the aforenoted prior art devices, in the axial direction of the enlarged guide passage 223 at the exit 222 thereof, resulting from an extremely reduced angle $\theta$ which is defined by surface b' of the mixing range B, on which the jet streams of a mixture fluid are mixed with an exterior stationary fluid, and by an axial line O. Accordingly, because of a reduced difference between velocities of the jet streams of a mixture fluid and the exterior stationary fluid, as well as between the central portion 225 and the circumferential portion 224 of the jet streams, there is an avoidance of a vortex, turbulence, or peeling of fluids, upon impingement of one fluid on the other, so that noise created from the stably and smoothly mixed fluids is lowered in level. The fluid velocity of a mixture fluid is increased in the direction perpendicular to the axial direction of the enlarged guide passage 223 at the exit 222, and the jet streams are spouted from the exit 222 in the direction parallel with the axis thereof. As a result, the jet streams around the circumferential portion 224 of the exit 222 may afford an improved shielding effect over that of the first embodiment, with the resulting freedom from the creation of a vortex, turbulence, peeling or the like between the jet streams and the stationary fluid thereat, resulting in lowered noise level. As a result, the curve of noise created from the paint spraying means of the second embodiment at varying pressure levels of a pressure fluid is shown by a symbol $Y_2$ in FIG. 7, so that a screech is completely eliminated, and the noise level may be lowered to a level of 23 dB with high accuracy at a high efficiency. Furthermore, despite some variation in pressure of a fluid supplied, a low noise level may be maintained in a stable and smooth condition, thereby improving the practical advantages.

FIG. 21 shows a paint spraying means $G_2$ which is a modification of the second embodiment shown in FIG. 20, and FIG. 22 shows an end view thereof. Such a modified paint spraying means G according to the second embodiment, comprises a stepped hollow cylinder including an inlet portion 210 as one opening portion of the stepped hollow cylinder; a projecting nozzle portion 201 at the smallest diameter portion of the stepped hollow cylinder, connected to the inlet portion 210 at one end thereof; an enlarged portion 202 as the other opening portion of the stepped hollow cylinder communicatively connected to the other end of the nozzle portion 201; and a liquid supply means. The projecting nozzle portion comprises a projecting nozzle port 211 having one end with a predetermined diameter $d_1$ which projects within an enlarged hollow portion or passage 221 of the enlarged portion 202 with a predetermined distance ($l_1$=2 mm) from the entrance 203 of portion 202, and having its other end connected to the inlet portion 210. The enlarged portion 202 comprises a first hollow cylinder portion having a predetermined constant diameter ($d_2$) larger than $d_1$, which defines an enlarged hollow portion or passage 221; a second hollow cylinder portion having a predetermined constant diameter (D) larger than $d_2$, which defines a further enlarged guide passage 223; and an outer wall comprising a first outer wall of a predetermined outer diameter larger than that of the nozzle portion 201, and a second outer wall of a predetermined outer diameter larger than that of the first outer wall with a portion 204 tapered or gradually decreased towards the exit 222 of the enlarged portion 202 at a predetermined tapered angle ($\theta$) and also having a predetermined thickness (t) at the exit 222 thereof. The enlarged portion has a predetermined length ($l_0$) from the exit 222 to the entrance 203 thereof. Passage 221 in the enlarged portion 202 is provided, at its upstream end, with an annular concave portion **213*b* of the same center axis as that of enlarged passage 221. The nozzle port 211 is provided with a projecting discharge port 213 projecting within the annular concave portion 213*b* in the axial direction of the passage 221, to a predetermined length or distance $l_1$ from the entrance 203 of the enlarged portion 202. The projecting discharge port 213 is engaged with the annular concave portion 213*b*. The passage 221 is also provided with an annular cavity 221*b* defined by an outer wall of the passage 221 and an inner wall of the annular concave portion 213*b*, which cavity is connected to paint supply means 250** communicating with a liquid paint supply source T and is open thereto, thereby enabling the supply of a paint in a given amount therein.

Figure 23:
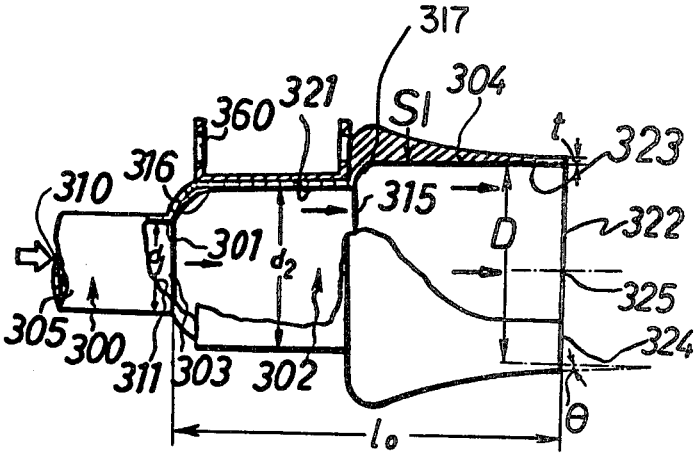
FIGS. 23 to 25 are views showing the outlines of an exhaust silencer means according to a third embodiment.
Figure 24:
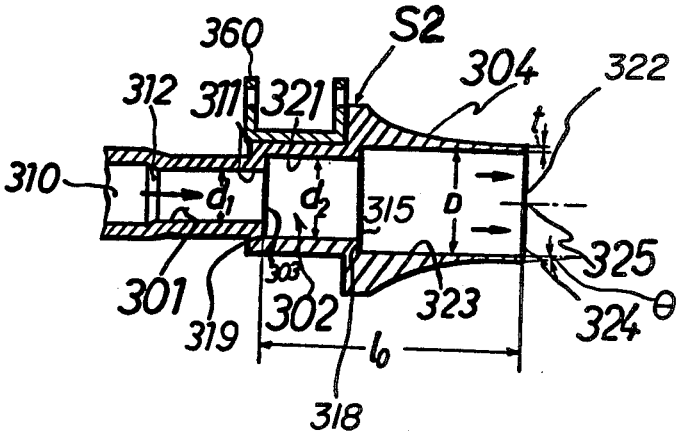
Figure 25:
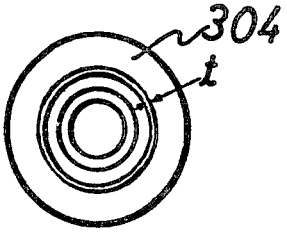

As shown in FIGS. 23 to 25, exhaust silencer means $S_1$ and $S_2$ according to the third embodiment of the present invention is so designed as to spout a pressure fluid outside of equipment in a plant.

The exhaust silencer means $S_1$ as shown in FIG. 23 comprises a stepped hollow cylinder including a pipe 300 having a first annular inner wall and a second annular inner wall, for use with a pressure flow for the exhaust silencer means $S_1$, and an enlarged portion 302 connected to the pipe 300. The pipe 300 is equipped in turn with an inlet portion 310 comprising one opening portion of the stepped hollow cylinder in the means S and a nozzle portion 301 comprising the smallest diameter portion of the stepped hollow cylinder, connected to the inlet portion 310, which portions 310, 301 are provided within the first annular inner wall of the pipe 300. The exhaust silencer means S communicates with an exhaust pipe 305 in an exhaust system at the upstream end of the inlet portion 310. The nozzle portion 301 includes a nozzle port 311 having a predetermined diameter ($d_1$). The enlarged portion 302 comprises the other opening portion of the stepped hollow cylinder and has a predetermined length ($l_0$) from an entrance 303 to an exit 322 thereof. The enlarged portion 302 comprises a first hollow cylinder portion having constant outer and inner diameters in the axial direction thereof and connected to the nozzle port 311 of the nozzle portion 301 through a curved shoulder portion 316 of the nozzle portion 301 and a second hollow cylinder portion having constant larger outer and inner diameters in the axial direction thereof than that of the first hollow cylinder portion and connected to the inner wall of the first hollow cylinder portion through a curved shoulder portion 317 of the second hollow cylinder portion. The inner wall of the first hollow cylinder portion defines an enlarged hollow portion or passage 321 of a predetermined diameter ($d_2$) larger than that of the nozzle port 311. The inner wall of the second hollow cylinder defines a further enlarged guide passage 323 of a predetermined diameter (D) larger than $d_2$, connected to the enlarged hollow portion or passage 321, for a part of the enlarged portion 302, positioned within the second annular wall of the pipe 300. Thus, the pipe 300 is further equipped with the enlarged hollow portion or passage 321 of a part of the enlarged portion 302 in the second annular inner wall thereof. The further enlarged guide passage 323 is provided with an outer wall having a tapered portion 304 and is connected to the other end of the pipe 300. The outer wall thereof is formed into a tapered configuration towards the exit 322 of the enlarged portion 302; that is, the tapered portion 304 is formed along a curved line which is radially inwardly offset with respect to a line joining the points of the inlet side and outlet side of the outer wall of the second hollow cylinder portion and at a predetermined angle ($\theta$) to the enlarged passage 321 of the second hollow cylinder portion at the exit thereof. The cross-sectional area of the linear passage 321 at the exit 315 thereof is almost the same as that of an entrance of a curvilinear passage of the curved shoulder portion 316 adjacent to an entrance 303, and the passage 321 communicates with the further enlarged cylindrical guide portion 323 of the enlarged portion, thus providing parallel opposed surfaces in its cross section, so that a pressure fluid may be spouted through exit 322 outside thereof. A portion or bracket 360, for attachment to other equipment, is secured to the outer peripheral surface of a wall of the enlarged passage 321 in the portion 302. The following is a preferred example of the exhaust silencer means of the third embodiment, similar to other specific examples stated herein. The distance $d_2$ between the opposed inner surfaces of a wall of the enlarged passage 321 in the portion 302 as viewed in its cross-section at the exit thereof is 14 mm. The distance $d_1$ between the opposed inner surfaces of a wall of the nozzle portion 301, as measured at the exit thereof in its cross-section, is 8 mm. The distance $l_0$ from the entrance 303 to the exit 322 of the enlarged portion 302, as measured along the center line thereof, is 20 mm. The distance D between the opposed inner surfaces of a wall of the further enlarged guide passage 323, as measured in cross-section at the exit 322, is 14 mm. An inclination angle $\theta$ defined by a tangent of the curvature of end portion 304 of the outer wall of the passage 323, and the center axis of passage 323 is 12°. The thickness t of the wall of the end portion 304 as measured at the exit 322 is 1.02 mm.

Furthermore, the cross-sectional area ($d_1$) of the jet of the nozzle portion 301, which is open to the enlarged passage 321, is 25.5 mm$^2$; a cross-sectional area ($d_2$) of the passage 321 in the enlarged portion 302 at the exit thereof is 89.76 mm$^2$; and a distance $l_0$ from the entrance 303 to the exit 322 of the enlarged portion 302 is 107 mm. Still further, the exhaust silencer means S of the third embodiment satisfies the following relationship:

$$l_0/d_2 = 1.42,\ \theta = 12°,\ t/d_2 = 0.071$$

in the hatched ranges defined by the lines I, II, III, IV and V, VI, VII, VIII in FIGS. 11 and 12 respectively, i.e., as shown at symbols $S_{10}$. The pressure of a fluid to be supplied from the inlet portion 310 falls in the range of 1 to 9 kg/cm$^2$.

In operation of the third embodiment having the aforenoted arrangement, a pressure fluid or flow is introduced from the jet of the nozzle portion 301 into the enlarged passage 321 of portion 302 and then is spouted or emitted through the exit 322 of the further enlarged guide passage 323 of the enlarged portion 302 outside thereof. At this time, the pressure fluid or flow in the third embodiment clings to the inner surface of a wall of the enlarged passage 321 due to negative pressure created at the stepped portion defined between the jet of the nozzle port 311 and the passage 321 of the enlarged portion 302. As a result, the aforenoted fluid streams may run in a stable and smooth condition, without being peeled from the inner surface of the wall of the enlarged passage 321, i.e., in a manner to cling thereto.

The velocity of a pressure fluid being spouted from the central portion 325 of the exit 322 in the third embodiment device is lower than the velocity of the fluid around the circumferential portion 324 thereof, thus exhibiting a velocity distribution as shown by line $X_3$ in FIG. 19. More particularly, with the exhaust silencer means of the third embodiment, because of the tapered configuration of the end portion 304 having a predetermined tapered angle ($\theta$) and wall thickness (t) at the exit 322, the flow resistance of the pressure flow may be reduced, so that the velocity of a pressure flow in the central portion 325 of the exit 322 is higher than that of a fluid around the circumferential portion 324 of the exit 322. As shown by the velocity distribution in the exhaust silencer means of the third embodiment seen in FIG. 19, line $X_3$, the direction of a pressure fluid being spouted or emitted is maintained in parallel with and between the opposed inner surfaces of the wall of the passage 323, and the fluid is spouted from the exit 322 outside. For this reason, as shown in FIG. 15 as the angle of direction of the exterior flow to the direction of the pressure flow from the exit 322 of the enlarged portion 302 is minimized by selecting a predetermined tapered angle ($\theta$) of the tapered portion of the enlarged portion 302 and a predetermined thickness (t) at the exit portion 322 of the enlarged portion, the fluctuation F in velocity of the jet stream becomes small. Hence, turbulence usually produced at the exit of the enlarged portion, gas-columnar-vibration based on this turbulence, and production of screech over wide range are prevented. The mixing range B of the jet streams with an exterior stationary flow is extremely narrow in the axial direction of the exit 322, as compared with that of the aforenoted prior art devices, and hence an angle ($\theta'$) defined by the surface b' on which the jet streams of a fluid pressure are mixed with the exterior stationary fluid, and by the axial line O, of the third embodiment silencer means is relatively small. Accordingly, because of a reduced difference in velocity of the aforenoted jet streams between the central portion 325 and the circumferential portion 324, there arises no marked production of a vortex, turbulence, peeling of the fluids, upon impingement of the jet streams on the exterior stationary fluid, thereby lowering the level of noise due to the stable and smooth mixing of the two types of fluids. In addition, the velocity of the fluid pressure is increased in the direction perpendicular to the axial direction of the exit 322, so jet streams may be spouted from the exit 322 in parallel with the axis of the exit 322, and the jet streams around the circumferential portion 324 of the exit 322 may afford an improved shielding effect, as compared with those of the aforenoted prior art devices, with the freedom from production of a vortex, turbulence, peeling or the like between the jet streams and the exterior stationary fluid thereat, thereby lowering the level of noise. Accordingly, the curve of noise created in the exhaust silencer means of the third embodiment at the varying pressures of a pressure fluid supply is shown by a symbol $Y_3$ in FIG. 9, thus eliminating a screech and lowering the level of noise to 25 dB, more positively, than the aforenoted prior art devices. Furthermore, even if the pressure of a pressure fluid is fluctuated within a range of a low noise level to some extent, there can be achieved stable and smooth maintenance of a low noise level, with the resulting improved advantages in the practical application.

FIG. 24 shows an exhaust silencer means $S_2$ which is a modification of the exhaust silencer means S according to the third embodiment as shown in FIG. 23, and FIG. 25 is an end view thereof. Such a modified exhaust silencer means $S_2$ according to the third embodiment, comprises a stepped hollow cylinder including an inlet portion 310 as one opening portion of the stepped hollow cylinder; a nozzle portion 301 of the smallest diameter portion of the stepped hollow cylinder, connected to the inlet portion 310 at one end thereof; an enlarged portion 302 as the other opening portion of the stepped hollow cylinder, connected to the other end of the nozzle portion 301; and a liquid supply means. The nozzle portion 301 comprises a nozzle port 311 having a predetermined diameter ($d_1$). The enlarged portion 302 comprises a first hollow cylindrical portion having a predetermined constant inner diameter ($d_2$) larger than $d_1$ and connected to the nozzle port 311 of the nozzle portion 301 through a stepped shoulder portion 319 thereof, which defines an enlarged hollow portion or passage 321; a second hollow cylindrical portion having a predetermined constant inner diameter (D) larger than $d_2$ and connected to the enlarged passage 321 through a stepped shoulder portion 318 thereof, which defines a further enlarged guide passage 323; and an outer wall comprising a first outer wall of a predetermined outer diameter larger than that of the nozzle portion 301, and a second outer wall of a predetermined outer diameter larger than that of the first outer wall. The second outer wall has a tapered portion 304 formed along a curved line which is radially inwardly offset with respect to a line joining the points of the inlet side and outlet side of the outer wall of the second hollow cylinder portion and has a predetermined angle ($\theta$) with respect to the enlarged passage 321 of the second hollow cylinder portion at the exit thereof and also has a predetermined thickness (t) at the exit 322 thereof. The enlarged portion 302 has a predetermined length ($l_0$) from the exit 322 to the entrance 303 thereof. The inlet portion 310 is connected to a pressure exhausting supply source through an exhaust pipe.

FIGS. 26 to 33 disclose alternative forms of the exit or discharge end of the invention and, in particular, specific modifications to the configuration of the tip portion, nozzle and enlarged portion shown in the previously discussed embodiments. The forms of FIGS. 26 to 33 will now be described wherein like parts are designated by like reference numerals and symbols, and description of duplicated structures will be omitted.

Figure 26:
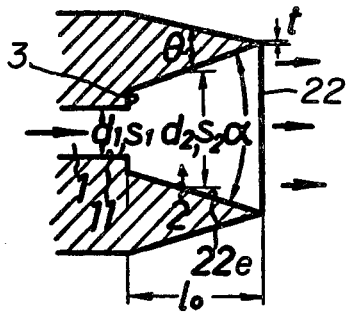
FIGS. 26 to 33 are views showing the outlines of other embodiments of the invention.

With a pressure fluid spouting device as shown in FIG. 26, a jet of the nozzle device comprises a nozzle means having a predetermined opening area $S_1$, and enlarged means having a predetermined average opening area $S_2$. The enlarged hollow portion 2 comprises a diverging straight inner wall **22*e*** having a predetermined diverging angle $\alpha$ and an outer wall having a straight tapered portion at the outlet side thereof with a predetermined tapered angle $\theta$ defined by the inner and outer walls of the enlarged means. The annular wall of the enlarged means has a predetermined thickness t at the exit or open end thereof.

The dimensional relation of the nozzle device is as follows:

$$l_0/d_2=1.428,\ \theta=18°,\ t/d_2=0.085,\ S_2/S_1=3.075 \text{ and } \alpha=2°.$$

This nozzle device more effectively attains the effect of preventing the production of screech by selecting $S_2/S_1$ and $\alpha$ as described above, compared with the above-described embodiments. As the pressure flows move along the diverging straight inner wall, the diverged pressure flows, that is, the pressure flows having a component of radial flow, are spouted from the exit of the enlarged means with the diverging angle $\alpha$ so that it is less likely that the exterior flow will move into the spouted pressure flow, and to mix the exterior flows and the spouted pressure flow.

Figure 27:
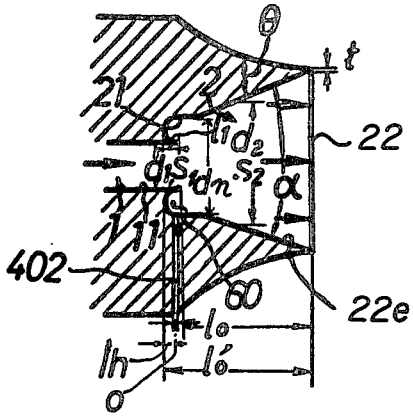

In a device shown in FIG. 27, the nozzle means comprises a projected nozzle port having a projecting length $l_1=7$ mm and a predetermined opening area $S_1=113$ mm$^2$. The enlarged means comprises a first inner wall having a predetermined constant diameter and a second inner wall in which the diameter gradually and linearly increases towards the exit thereof in the axial direction. A passage 21 of the enlarged means 2 is provided with an annular cavity 60 defined by an outer wall of the passage 21 and a projected portion of the projected nozzle port 11. A tapered portion of an outer wall of the enlarged means is formed along a curved line which is radially inwardly offset with respect to a line joining the points of the inlet side and outlet side of the outer wall and which has a predetermined angle $\theta=15°$ to the second inner wall at the exit thereof and a predetermined thickness $t=0.8$ mm at the exit thereof. The first inner wall having a predetermined distance $d_n=9$ mm between the opposed walls thereof has an opening passage 402 having a opening area $fh_n=3.14$ and connecting to the enlarged passage and the atmosphere, provided at a part which is at the predetermined distance $lh_n=5$ mm from an inlet end of the first inner wall in the axial direction thereof. The second inner wall has a predetermined angle $\alpha=2°$ between opposed walls at the exit thereof. The enlarged means has a predetermined total length $l_0=22$ mm, a predetermined length $l_0=15$ mm from the exit of the projected nozzle port to the exit of the enlarged means, and average opening area $S_2=452\ mm^2$.

The dimensional relation of this nozzle device is as follows:

$$\frac{l_0}{d_2} = 1.25,\ \beta = 15°,\ \frac{t}{d_2} = 0.066,\ \frac{S_2}{S_1} = 4.0,\ \alpha = 2°,\ \frac{lh_n}{d_n} = \frac{5}{9} = 0.56,$$

$$\frac{\frac{fh_n}{d^2_n}}{\frac{lh_n}{d_n} - 0.282} = 0.14,\ \frac{l_0'}{d_n} = \frac{22}{9} = 2.4,$$

$$0.27 \times \frac{l_0'}{d_n} \leqq \frac{l_1}{d_n} \leqq \frac{l_0'}{d_n} - 0.6, \text{ and}$$

$$\left[0.27 \times \frac{l_0'}{d_n} = 0.66\right] < \left[\frac{l_1}{d_n} = 0.78\right] < \left[\frac{l_0'}{d_n} - 0.6 = 1.84\right]$$

In this nozzle device, as the pressure flows move along the diverging second inner wall, the diverged pressure flows having a component of radial flow are spouted from the exit thereof with the diverging angle $\alpha$, so that it is less likely for the exterior flow to move into the spouted pressure flow, and to mix the exterior flows and the spouted pressure flow.

As the relation $l_0/d_2$ of the length $l_0=l_0'-l_1$ and the distance $d_2$ of the enlarged means is properly adjusted by the projecting length $l_1$ of the projected nozzle port, the negative pressure is more effectively produced at the inner wall of the enlarged means, and then, the pressure flow can cling to the inner wall thereof and be spouted from the exit thereof outside as a steady and stable pressure flow.

As the exterior air is introduced within an enlarged passage through the opening passage thereof and flows along the inner wall of the enlarged means, the peripheral pressure flow along the inner wall of the enlarged means is strengthened by the introduced exterior flow. Accordingly, the nozzle device more effectively prevents the production of screech, compared with the nozzle device as shown in FIG. 26.

Still furthermore, nozzle devices shown in FIGS. 28 to 33 have the same preventing effect of screech as the nozzle device shown in FIG. 26.

Figure 28:
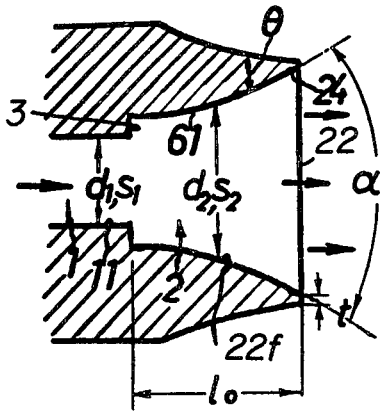
Figure 29:
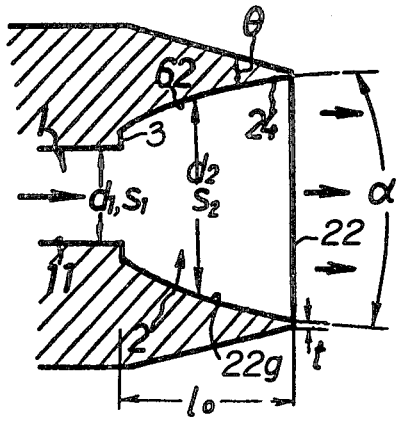

The devices shown in FIGS. 28 to 29 differ from the aforenoted respective embodiment in which the walls of the diverging passages 22*e* follow a linear line in cross section. In FIGS. 28 and 29, $S_2$ represents average opening area of the inner wall 22*b*, 22*c* of the enlarged means, which communicate with the nozzle 1 in the diverging passages of given radii of curvature. More particularly, angles $\alpha$ of the diverging passages 22F and 22G respectively defined by lines connecting the entrances to the exits of arcuate curves 61, 62, in the cross-sectional planes, thus improving the center lines of diverging passages.

The dimensions of the nozzle device shown in FIG. 28 are as follows:

$d_1=8$ mm, $d_2=14$ mm, $l_0=15$ mm, $t=0.85$ mm, $\theta=5°$, $S_1=200\ mm^2$, $S_2=615\ mm^2$, $\alpha=4°$, $l_0/d_2=1.07$, $t/d_2=0.061$, $S_2/S_1=3.07$.

The dimensions of the nozzle device shown in FIG. 29 are as follows:

$d_1=8$ mm, $d_2=12$ mm, $l_0=15$ mm, $t=0.6$ mm, $\theta=15°$, $S_1=200\ mm^2$, $S_2=452\ mm^2$, $\alpha=3.8°$, $l_0/d_2=1.25$, $t/d_2=0.05$, $S_2/S_1=2.26$.

Figure 30:
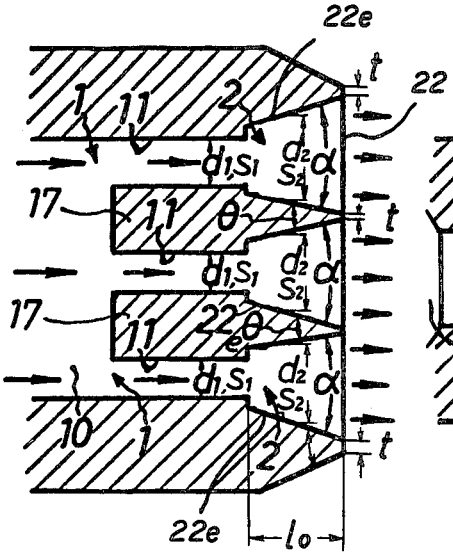
Figure 31:
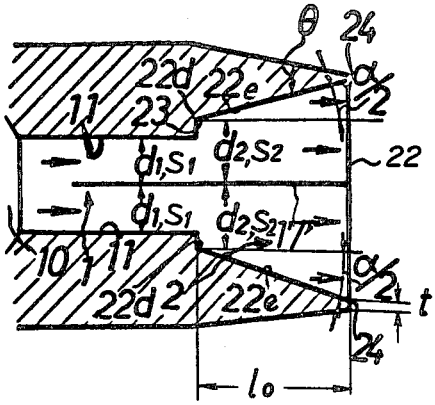

The devices shown in FIGS. 30, 31 provide two or more nozzles and diverging hollow portions. With the device of FIG. 30, three nozzles 1 divided by two partition (intermediate) members 17 are provided in communication with a single inlet portion 10, with respective nozzles 1 being in communication with the diverging hollow portions 2 having given diverging angles.

The dimensions of the nozzle device shown in FIG. 30 are as follows:

$d_1=4$ mm, $d_2=6$ mm, $l_0=6$ mm, $t=0.5$ mm, $\theta=12°$, $S_1=50.2\ mm^2$, $S_2=113\ mm^2$, $\alpha=3°$, $l_0/d_2=1.0$, $t/d_2=0.083$, $S_1/S_2=2.25$.

The device shown in FIG. 31 provides a partition plate 17' in the inlet portion 10, thereby defining a pair of nozzles and a pair of diverging hollow portions 2. $S_2$ represents the average opening areas of entrances 22*d* which communicate with nozzles 1, the aforenoted entrances 22*d* being defined by walls of the diverging hollow passage 22*e* and the partition member 17. The diverging angles $\alpha$ of the diverging hollow passages 22*e* are defined by the angle of diverging hollow passages 22*e*. The length of the partition member 17 extending into the diverging hollow portions 2 may be reduced to an extent up to the position of the exit 11 of the nozzle 1.

The dimensions of the nozzle device shown in FIG. 31 are as follows:

$d_1=4$ mm, $d_2=8$ mm, $l_0=15$ mm, $t=0.8$ mm, $\theta=10.5°$ $S_1=50.2\ mm^2$, $S_2=200\ mm^2$, $\alpha=2.5°$, $l_0/d_2=1.875$, $t/d_2=0.1$, $S_2/S_1=3.98$.

Figure 32:
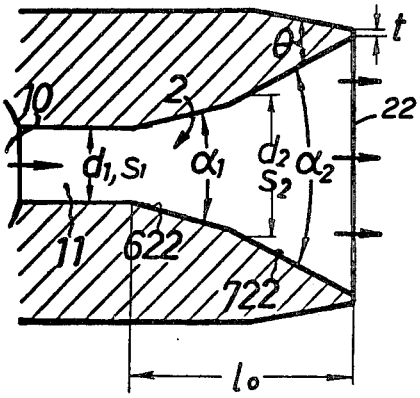
Figure 33:
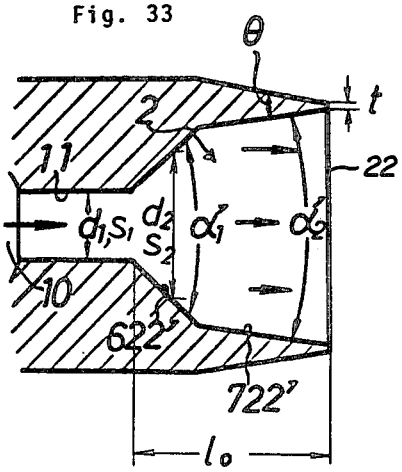

The devices shown in FIGS. 32 and 33 provide two or more diverging passages which are continuous with each other and have different diverging angles. As shown in FIG. 32, a diverging angle $\alpha_1$ of a first diverging hollow passage 622 communicating with the nozzle 1 is smaller than a diverging angle $\alpha_2$ of a second diverging hollow passage 722 ($\alpha_1 \leqq \alpha_2$).

The dimensions of the nozzle device shown in FIG. 32 are as follows:

$d_1=6$ mm, $d_2=10$ mm, $l_0=10$ mm, $t=0.45$ mm, $\theta=3°$, $S_1=113\ mm^2$, $S_2=314\ mm^2$, $\alpha_1=2°$, $\alpha_2=3.5°$, $l_0/d_2=1.0$, $t/d_2=0.045$, $S_2/S_1=2.78$.

As shown in FIG. 33, a diverging angle $\alpha'_1$ of a first diverging hollow passage 622' communicating with nozzle 1 is larger than a diverging angle $\alpha'_2$ of a second diverging hollow passage 722' communicating therewith ($\alpha'_1 > \alpha'_2$). The aforenoted diverging angles, $\alpha'_1$, $\alpha'_2$ fall in a range of 0.5° to 4°.

The dimensions of the nozzle device shown in FIG. 33 are as follows:

$d_1=8$ mm, $d_2=14$ mm, $l_0=20$ mm, $t=1.2$ mm, $\theta=18°$, $S_1=200$ mm$^2$, $S_2=615$ mm$^2$, $\alpha'_1=4°$, $\alpha'_2=1.5°$, $l_0/d_2=1.428$, $t/d_2=0.085$, $S_2/S_1=3.07$.

Alternatively, there may be various combinations of the diverging hollow passage in the axial directions thereof, or there may be passages for a pressure fluid which are of flat, elliptic, rectangular cross-sectional shapes or of shapes of various combinations thereof.

Furthermore, there may be adopted multiple stages of linear passages and diverging passages or diverging passages which extend in the axial direction thereof, and communicate with the nozzle. Still furthermore, the cross-sectional shape of a pressure fluid discharge passage, diverging hollow portion or enlarged hollow portion for a pressure fluid may be of flat, elliptic, and rectangular shape, and so on.

In short, according to a low noise level, pressure fluid spouting device of the present invention, a pressure fluid is introduced from the inlet portion, to a nozzle portion having a pressure fluid passage or port communicating with the inlet portion, and then spouted through a pressure fluid enlarged passage of the enlarged portion having an end portion of a tapered shape outside thereof, with the result that the velocity of streams in the central portion of the exit of the pressure fluid enlarged passage may be lowered, as compared with the velocity of a pressure fluid around the circumferential portion of the exit of the pressure fluid enlarged passage.

According to the device of the present invention, the velocity of a pressure fluid passing through the central portion of a pressure fluid enlarged passage is lower than that of a pressure fluid around the circumferential portion of the exit of the fluid pressure, so that a mixing range of the jet streams of a pressure fluid with an exterior stationary pressure fluid may be narrowed, thereby minimizing or eliminating the production of a vortex, turbulence, peeling of fluids and the like. As a result, the level of noise may be lowered, and the streams of a pressure fluid may be rendered stable and smooth, thereby suppressing the production of high level noise; hence, providing low level noise, with the resulting marked improvement in operational circumstances and many advantages in the practical application. Furthermore, the device according to the invention is compact in size, easy in manufacture and low in cost.

The enlarged hollow portion or diverging hollow portion of the enlarged portion in the pressure fluid spouting device according to the present invention meets the following relationship:

$$0.67 \leqq l_0/d_2 \leqq 1.875 \ldots \quad (1),$$

wherein $l_0$ represents a predetermined length or distance between the entrance and the exit of the enlarged portion of a pressure fluid passage, as measured along the center line of the enlarged portion, and $d_2$ represents a predetermined distance between the opposed inner surfaces of a wall of the enlarged portion, as measured at the exit of the nozzle which is open to the enlarged hollow portion or passage of the enlarged portion. Furthermore, the outer configuration of the aforenoted enlarged portion is such that the outer peripheral surface of a wall of the enlarged portion is gradually decreased in the axial direction thereof and meets the following relationships:

$$3° \leqq \theta \leqq 20 \ldots \quad (2)$$

$$0.42 \leqq t/d_2 \leqq 0.125 \ldots \quad (3),$$

wherein $\theta$ represents a predetermined inclination defined by the inner surface and the outer surface of a wall of the enlarged portion, and t represents a thickness of a wall of the enlarged portion, as measured at the exit of the enlarged portion. The relationships ensure the lowering of the level of noise.

Furthermore, a ratio $S_2/S_1$ in opening area, of the jet of a nozzle portion to the enlarged hollow portion or passage of the enlarged portion in the device according to the invention may meet the following relationship, in addition to the fact that the constituting elements of the device meet the numerical relationships (1), (2), (3)

$$1.9 \leqq S_2/S_1 \leqq 9.6,$$

wherein $S_1$ represents the opening area of the nozzle port of the nozzle portion which communicates with the inlet portion for the pressure fluid at one end thereof and opens to the enlarged hollow portion or passage of the enlarged portion at the other end thereof, and $S_2$ represents the opening area of an entrance of the enlarged hollow portion of the enlarged portion, as measured at the exit of the nozzle portion. Still furthermore, a diverging angle ($\alpha$) of the diverging hollow portion of the enlarged portion, which diverges in the axial direction of the device, is maintained within a range of 0.5° to 4°, the aforenoted diverging angle ($\alpha$) being defined by connecting the entrance to the exit of the inner surface of a wall of the diverging hollow portion, as measured in a plane including the center line of the diverging passage having an inner surface diverging outwardly. Therefore, as the pressure fluid moves along the diverging straight inner wall, the diverged pressure fluid having a component of radial flow is spouted from the exit of the enlarged means with the diverging angle $\alpha$ so that it is less likely for the exterior flow to extend into the spouted pressure flow, and to mix the exterior flows and the spouted pressure flow. As a result, the level of noise may be lowered, the pressure range of a pressure fluid or flow may be widened, and hence the low noise level may be maintained in a stable and smooth condition, even if the pressure of pressure fluid or flow supplied varies to some extent.

Still further, with the device according to the third aspect of the present invention, the numerical ranges of the aforenoted constituting element or means meet the relationships (1), (2), (3); there are provided an inlet portion for introducing a pressure fluid, a nozzle portion communicating with the inlet portion and an enlarged portion with an enlarged hollow portion or passage communicating with a nozzle port of the nozzle portion, whereby a pressure fluid can be introduced from the inlet portion into the nozzle portion and then spouted from the enlarged hollow portion or passage of the enlarged portion, outside thereof.

A pressure fluid discharge passage or nozzle port for the nozzle portion may be so designed as to project into the enlarged hollow portion or passage of the enlarged portion in a direction from the entrance to the exit of the enlarged hollow portion, with the tip of the nozzle port being used as a jet of a nozzle portion. There is defined an annular cavity between the outer peripheral surface of a wall of the pressure fluid discharge passage in a nozzle portion and the inner surface of a wall of the enlarged hollow portion, and the pressure fluid spouting device according to such invention satisfies one of the following combinations of relationships:

$$3.5 \leqq l_0'/d_0,\ 0.83 \leqq l_0'/d_0, \text{ and } 0.2 \leqq l_1/d_0 \leqq l_0'/d_0 - 0.6 \ldots \quad \text{(a)}$$

$$3.5 \leqq l_0'/d_0,\ 0.83 \leqq l_0'/d_0, \text{ and } 0.2 \leqq l_3/d_0 \leqq 2.0, \text{ or } 0.74 l_0'/d_0 \leqq l_3/d_0 \leqq l_0'/d_0 - 0.6 \ldots \quad \text{(b)}$$

$$3.5 \leqq l_0'/d_0 \leqq 1.0, \text{ and } 0.27 l_0'/d_0 \leqq l_3/d_0 \leqq l_0'/d_0 - 0.6 \ldots \quad \text{(c)}$$

wherein $l_0'$ represents a predetermined length or distance between the entrance and the exit of the aforenoted enlarged portion, $l_3$ represents a predetermined length or distance of the pressure fluid discharge passage or nozzle port in the nozzle portion, as measured from the entrance of the hollow enlarged portion in the enlarged portion to the jet of the nozzle portion, and $d_0$ represents a predetermined distance between the opposed inner surfaces of a wall of the enlarged hollow portion in cross-section, as measured at the jet of the nozzle portion, which is open to the enlarged hollow portion of the enlarged portion.

Stated differently, the device according to the present invention satisfies one of the aforesaid combination (a), (b), (c), and the numerical values of the aforenoted constituting elements meet the aforenoted relationships (1), (2), (3), for the objects of the use thereof.

As the relation $l_0/d_2$ of the length $l_0 = l_0' - l_1$ and the distance $d_2$ of the enlarged means is properly adjusted by the projecting length $l_1$ of the projected nozzle port, the negative pressure is more effectively produced at the inner wall of the enlarged means and the gas-columnar vibration is damped by the compressive negative region formed by the projected port of the nozzle portion and the inner wall of the enlarged means. As a result, the pressure flow can cling to the inner wall thereof and be spouted from the exit thereof outside as a steady and stable pressure flow.

Thus, streams of a pressure fluid or flow may be rendered stable and smooth, thereby providing a noise pattern which may eliminate the production of screech, so that the range of a low noise level may be positively widened and the operational circumstances may be markedly improved, with the accompanying advantages in the practical application.

Furthermore, with the device according to the present invention which meets the aforenoted relationships (1), (2), (3), and includes an inlet portion for introducing a pressure fluid or flow, a nozzle portion communicating with the inlet portion, and an enlarged portion with an enlarged hollow portion or passage communicates with a jet of the nozzle portion, a pressure fluid may be introduced through the inlet portion into the nozzle portion, then the enlarged hollow portion of the enlarged portion, and then be spouted therefrom outside. At least one passage which communicates with the atmosphere may be open to the annular cavity from the inner surface of a wall of the aforenoted enlarged hollow portion in the enlarged portion, and the following relationships are satisfied:

$$\text{in case } lh_n/d_n \leqq 0.3 \quad \sum_{n=1}^{k} \frac{fh_n}{d^2_n} \geqq 0.0014$$

$$\text{in case } lh_n/d_n \leqq 0.3 \quad \sum_{n=1}^{k} \frac{fh_n/d^2_n}{\frac{ih_n}{d_n} - 0.282} \geqq 0.0798$$

wherein $fh_n$ represents a predetermined minimum open cross-sectional area of the 'n'th communicating passage ('n' is a positive integer) which is open from the inner surface of a wall of a 'n'th enlarged hollow portion, $lh_n$ represents a predetermined distance between the jet of the nozzle portion and the center of the opening of the 'n'th communicating passage, as measured along the center line of the enlarged hollow portion, $d_n$ represents a predetermined distance between the opposed inner surfaces of a wall of the 'n'th enlarged portion, as measured at the exit of the 'n'th communicating passage, which is open to the 'n'th enlarged hollow portion, and k is the total of communication passages (k is a positive integer).

According to this device, as the exterior air is introduced within an enlarged passage through the opening passage and the pressure flows are exhausted from the enlarged passage to the outside through at least one opening passage, and flow along the inner wall of the enlarged means is strengthened by the introduced exterior flow, the gas-columnar-vibration is damped. Depending on the objects of the application, the numerical values of the aforenoted constituting elements or means are selected so as to meet the aforenoted relationships (1), (2), (3), and the above relationships are suitably selected and combined, so that the streams of a pressure fluid may be rendered smooth to avoid the production of screech, thereby widening the range of a low noise level and simplifying the adjusting operation of a noise level. As a result, the operational circumstances can be markedly improved and so are the practical advantages.

Still furthermore, by selecting and combining the aforenoted numerical values, the respective embodiments of the present invention may provide substantially the same result as those described above.

While specific embodiments of a low noise level, pressure fluid spouting device have been disclosed in the foregoing description, it will be understood that still other modifications within the spirit of the invention may occur to those skilled in the art. Therefore, it is intended that no limitations be placed on the invention except as defined by the scope of the appended claims.

What is claimed is:

1. A low noise level, pressure fluid spouting device comprising inlet means for introducing a pressure fluid therein provided at one end portion of said device, nozzle means connected to said inlet means at one end thereof, for jetting the pressure fluid from the inlet means, said nozzle means having an annular inner wall of a predetermined diameter, said annular inner wall forming a nozzle port communicating with said inlet means;

enlarged means connected to the other end of said nozzle means and provided at the other end of said device, for spouting the pressure fluid from said nozzle means, said enlarged means having an annular inner wall with a predetermined distance ($d_2$) between the opposed inner walls larger than that of said nozzle means and a predetermined length ($l_0$) in the axial direction thereof, and a dimensional relationship of said enlarged means comprising $$0.67 \leqq l_0/d_2 \leqq 1.875,$$

said annular inner wall comprising an enlarged passage communicating with said nozzle port of said nozzle means, whose exit is open to spout the pressure fluid, said enlarged means having an annular outer wall, whereby high negative pressure is produced at said inner wall of said enlarged means, the streams flowing out of said nozzle means steadily and stably cling to said inner wall of said enlarged means and are spouted from the exit of said enlarged means as strong and steady streams beyond said inner wall of said enlarged means, and turbulence at the exit of said enlarged means and the production of screech are prevented.

2. A low noise level, pressure fluid spouting device according to claim 1, wherein said enlarged means has a tapered portion at an outlet side of said outer wall thereof, in which the outer diameter is gradually decreased with a predetermined angle ($\theta$) to said inner wall of said enlarged means at an exit thereof, and a range of said predetermined angle of said tapered portion is as follows:

$$3° \leqq \theta \leqq 20°,$$

whereby the angle of the direction of the exterior flow to the direction of the pressure flow from the exit of said enlarged means is reduced by making the exterior flow flow along said tapered portion and the fluctuation in velocity of the spouted jet stream is reduced, and then the turbulence at the exit of said enlarged means, the gas-columnar-vibration based on said turbulence and the production of screech are prevented.

3. A low noise level, pressure fluid spouting device according to claim 2, wherein an exit of said tapered portion of said enlarged means has a predetermined thickness (t) between said outer wall and said inner wall, and the dimensional relation of said thickness (t) of said tapered portion and the distance ($d_2$) between opposed inner wall of said enlarged means is as follows:

$$0.042 \leqq t/d_2 \leqq 0.125$$

whereby the amount of the exterior flow accompanied by the pressure flow is adjusted by the thickness (t) of said tip portion of said tapered portion and mixing energy of the exterior flow to the pressure flow becomes small, and the production of screech is more effectively prevented.

4. A low noise level, pressure fluid spouting device according to claim 3, wherein the opening area of said inner wall of said enlarged means is gradually increased from the inlet side to the outlet side in the axial direction thereof, said enlarged passage of said enlarged means having a predetermined angle ($\alpha$) to the axis of said enlarged passage, said nozzle means has a predetermined opening area ($S_1$) between the opposed inner walls, said enlarged passage of said enlarged means has a predetermined average opening area ($S_2$) of said inner wall, and the relationships of the dimension of said area ($S_1$) of said nozzle means with said area ($S_2$) of said enlarged passage of said enlarged means, and with said angle ($\alpha$) of said enlarged passage of said enlarged means are as follows:

$$1.9 \leqq S_2/S_1 \leqq 9.4$$

$$0.5 \leqq \alpha \leqq 4°$$

whereby the pressure flows move along said inner wall having said predetermined angle ($\alpha$), the pressure flows having a component of radial flow are spouted from the exit thereof with the angle ($\alpha$), so that it is less likely for the exterior flow to meet the spouted pressure flow and to mix the exterior flows and said spouted flow.

5. A low noise level, pressure fluid spouting device according to claim 3, wherein said enlarged means has at least one opening passage extending from said inner wall at a predetermined distance $d_n$ between the opposed walls thereof to said outer wall and connecting said enlarged passage and the atmosphere, n'th order opening passage has a predetermined opening area $fh_n$ thereof and a distance ($lh_n$) from said opening passage to said exit of said nozzle means in the axial direction of said enlarged passage, and the relationships of the dimensions of said predetermined distance ($d_n$) of said enlarged means, predetermined opening area ($fh_n$) and the distance ($lh_n$) of said at least one opening passage are as follows:

$$\text{in case of } lh_n/d_n \leqq 0.3$$
$$\sum_{n=1}^{k} \frac{fh_n}{(d_n)^2} \geqq 0.0014, \text{ and}$$
$$\text{in case of } lh_n/d_n \geqq 0.03$$
$$\sum_{n=1}^{k} \frac{\dfrac{fh_n}{(d_n)^2}}{\dfrac{lh_n}{d_n} - 0.282} \geqq 0.798$$

whereby exterior air is introduced within said enlarged passage through opening passages and the pressure flows are exhausted from said enlarged passage to the outside through said at least one opening passage, and flow along said inner wall of said enlarged means, the peripheral pressure flow along said inner wall thereof is strengthened by said introduced exterior flow and the gas-columnar-vibration is damped by introducing the exterior air or exhausting the pressure flows.

6. A low noise level, pressure fluid spouting device according to claim 3, wherein said nozzle means has a projected nozzle port extending within said enlarged passage of said enlarged means with a predetermined length ($l_1$), said enlarged passage of said enlarged means has a predetermined length ($l_0'$) and predetermined distance $d_2$ between the opposed inner walls, and the relationships of the dimensions of said length ($l_1$) of said projecting nozzle port and said length ($l_0'$)

and distance ($d_2$) of said enlarged passage are as follows:

in case of $3.5 \leqq l_0'/d_2$ and $0.83 < l_0'/(d_2)^2$, $0.2 \leqq l_1/d_2 \leqq l_0'/d_2 - 0.6$;

in case of $3.5 \leqq l_0'/d_2$ and $0.83 \geqq l_0'/(d_2)^2$, $0.2 \leqq l_0'/d_2 \leqq 2.0$ or $0.74 l_0'/d_2 \leqq l_1/d_2 \leqq l_0'/d_2 - 0.6$; and in case of $3.5 \geqq l_0'/d_2 \geqq 1.0$ $0.27 l_0'/d_2 \leqq l_1/d_2 \leqq l_0'/d_2 - 0.6$, whereby the relation $l_0'/d_2$ of length $l_0'$ and the distance $d_2$ of enlarged means is properly adjusted by the projecting length $l_1$ of said projected nozzle port, the negative pressure is more effectively produced at said inner wall of said enlarged means and the gas-columnar vibration is damped by the compressive negative region formed by said projected port of said nozzle means and said inner wall of said enlarged means.

7. A low noise level, pressure fluid spouting device according to claim 4, wherein said enlarged means has at least one opening passage extending from said inner wall at a predetermined distance $d_n$ between the opposed walls thereof, to said outer wall and connecting said enlarged passage and atmosphere, n'th order opening passage has a predetermined opening area $fh_n$ thereof and a distance ($1h_n$) from said opening passage to said exit of said nozzle means in the axial direction of said enlarged passage, and the relationships of the dimensions of said predetermined distance ($d_n$), predetermined opening area ($fh_n$) and the distance ($1h_n$) of said at least one opening passage are as follows:

in case of $lh_n/d_n \leqq 0.3$ $$\sum_{n=1}^{k} \frac{fh_n}{(d_n)^2} \geqq 0.0014, \text{ and}$$

in case of $lh_n/d_n \geqq 0.3$ $$\sum_{n=1}^{k} \frac{\dfrac{fh_n}{(d_n)^2}}{\dfrac{lh_n}{d_n} - 0.282} \geqq 0.0798$$

8. A low noise level, pressure fluid spouting device according to claim 4, wherein said nozzle means has a projected nozzle port extending within said enlarged passage of said enlarged means with a predetermined length ($l_1$), said enlarged passage of said enlarged means has a predetermined length ($l_0$) and predetermined distance ($d_2$) between the opposed inner wall, the relationships of the dimensions of said length ($l_1$) of said projecting nozzle port and said length ($l_0$) and distance ($d_2$) of said enlarged passage are as follows:

in case of $3.5 \leqq l_0/d_2$ and $0.83 < l_0/(d_2)^2$, $0.2 \leqq l_1/d_2 \leqq l_0/d_2 - 0.6$;

in case of $3.5 \leqq l_0/d_2$ and $0.83 \geqq l_0/(d_2)^2$, $0.2 \leqq l_0/d_2 \leqq 2.0$ or $0.74\ l_0/d_2 \leqq l_1/d_2 \leqq l_0/d_2 - 0.6$; and in case of $3.5 \geqq l_0/d_2 \geqq 1.0$ $0.27\ l_0/d_2 \leqq l_1/d_2 \leqq l_0/d_2 - 0.6$.

9. A low noise level, pressure fluid spouting device according to claim 4, wherein said enlarged means has at least one opening passage extending from said inner wall to said outer wall and connecting said enlarged passage and the atmosphere, n'th order opening passge has a predetermined distance $d_n$ between the opposed walls thereof, a predetermined opening area $fh_n$ thereof and a distance $1h_n$ from said opening passage to said exit of said nozzle means in the axial direction of said enlarged passage, the relationships of the dimensions of said predetermined distance $d_n$, predetermined opening area $fh_n$ and the distance $1h_n$ of said at least one opening passage are as follows:

in case of $lh_n/d_n \leqq 0.3$ $$\sum_{n=1}^{k} \frac{fh_n}{(d_n)^2} \geqq 0.0014, \text{ and}$$

in case of $lh_n/d_n \geqq 0.3$ $$\sum_{n=1}^{k} \frac{\dfrac{fh_n}{(d_n)^2}}{\dfrac{lh_n}{d_n} - 0.282} \geqq 0.0798$$

said nozzle means has a projected nozzle port extending within said enlarged passage of said enlarged means with a predetermined length ($l_1$), said enlarged passage of said enlarged means has a predetermined length ($l_0$) and predetermined distance ($d_2$) between the opposed inner walls, and the relationships of the dimensions of said length ($l_1$) of said projecting nozzle port and said length ($l_0$) and distance ($d_2$) of said enlarged passage are as follows:

in case of $3.5 \leqq l_0/d_2$ and $0.83 < l_0/(d_2)^2$, $0.2 \leqq l_1/d_2 \leqq l_0/d_2 - 0.6$;

in case of $3.5 \leqq l_0/d_2$ and $0.83 \geqq l_0/(d_2)^2$, $0.2 \leqq l_0/d_2 \leqq 2.0$ or $0.74(l_0/d_2) \leqq l_1/d_2 \leqq l_0/d_2 - 0.6$; and in case of $3.5 \geqq l_0/d_2 \geqq 1.0$ $0.27(l_0/d_2) \leqq l_1/d_2 \leqq l_0/d_2 - 0.6$.

10. A low noise level, pressure fluid spouting device according to claim 3, wherein the diameter of said inner wall of said enlarged means adjacent to said other end of said device is constant in the axial direction thereof.

11. A low noise level, pressure fluid spouting device according to claim 10, wherein said inner wall of said enlarged means comprises at least two inner walls which are serially provided in the axial direction thereof and respectively connected and each of which has a constant diameter in the axial direction thereof, the diameter of an inlet side inner wall being smaller than that of an outlet side inner wall.

12. A low noise level, pressure fluid spouting device according to claim 10, wherein said inner wall of said enlarged means comprises two inner walls which are serially provided in the axial direction thereof and respectively connected, the diameter of an inlet side inner wall being constant in the axial direction thereof, and the diameter of an outlet side inner wall being gradually increased towards the exit thereof in the axial direction.

13. A low noise level, pressure fluid spouting device according to claim 3, wherein the diameter of said inner wall of said enlarged means is gradually increased from the entrance towards the exit of said enlarged means in the axial direction thereof.

14. A low noise level pressure fluid spouting device according to claim 13, wherein said inner wall of said enlarged means is formed along at least one straight line having a predetermined angle to the axis of said enlarged means.

15. A low noise level, pressure fluid spouting device according to claim 14, wherein said inner wall of said enlarged means is formed along a straight line having a predetermined angle to the axis of said enlarged means.

16. A low noise level, pressure fluid spouting device according to claim 14, wherein said inner wall of said enlarged means is formed along two straight lines having different predetermined angles to the axis of said enlarged means.

17. A low noise level, pressure fluid spouting device according to claim 16, wherein the angle of said inlet side inner wall of said enlarged means is smaller that that of said outlet side inner wall of said enlarged means.

18. A low noise level, pressure fluid spouting device according to claim 16, wherein the angle of said inlet side inner wall of said enlarged means is larger than that of said outlet side inner wall of said enlarged means.

19. A low noise level, pressure fluid spouting device according to claim 13, wherein said inner wall of said enlarged means is formed along a curved line having a predetermined angle to the axis of said enlarged means.

20. A low noise level, pressure fluid spouting device according to claim 19, wherein said inner wall of said enlarged means is formed along said curved line which is radially inwardly offset with respect to a line joining the points of the inlet side and outlet side of said curved line.

21. A low noise level, pressure fluid spouting device according to claim 19, wherein said inner wall of said enlarged means is formed along said curved line which is radially outwardly offset with respect to a line joining the points of the inlet side and outlet side of said curved line.

22. A low noise level, pressure fluid spouting device according to claim 3, wherein said tapered portion of said outer wall of said enlarged means is formed along a straight line having a predetermined angle to the axis of said enlarged means.

23. A low noise level, pressure fluid spouting device according to claim 3, wherein said tapered portion of said outer wall of said enlarged means is formed along a curved line having a predetermined angle to the axis of said enlarged means.

24. A low noise level, pressure fluid spouting device according to claim 3, wherein said nozzle means and enlarged means comprise a plurality of nozzle means parts and enlarged means parts, respectively.

25. A low noise level, pressure fluid spouting device according to claim 24, wherein said nozzle means and enlarged means comprise two nozzle means parts and two enlarged means parts, respectively.

26. A low noise level, pressure fluid spouting device according to claim 24, wherein said nozzle means and enlarged means comprise three nozzle means parts and three enlarged means parts, respectively.

27. A low noise level, pressure fluid spouting device according to claim 11, wherein said tapered portion of the outer wall of said enlarged means is formed along a straight line having a predetermined angle to the axis of said enlarged means.

28. A low noise level, pressure fluid spouting device according to claim 27, wherein said inlet means comprises one opening portion of a hollow cylinder having a constant outer diameter and different inner diameters, said nozzle means comprises an inlet tapered inner wall of said hollow cylinder connecting to said one opening portion, a throttled inner wall having a predetermined diameter of said hollow cylinder connected to said inlet tapered inner wall, and an outlet tapered inner wall of said hollow cylinder connected to said throttled inner wall, said enlarged means comprises a small inner wall of said hollow cylinder, having a constant diameter in the axial direction thereof, connected to said outlet tapered inner wall of said nozzle means, a large inner wall of said hollow cylinder, having a constant diameter in the axial direction larger thereof than that of said small inner wall, connected to said small inner wall by a stepped bottom portion thereof, and said tapered portion provided at the outlet side of said outer wall of said hollow cylinder.

29. A low noise level, pressure fluid spouting device according to claim 28, wherein said inlet means has a threaded part at the inlet side of said outer wall thereof which engages with a threaded portion of a pressure flow introducing pipe of a gas nozzle having a valve means for controlling the opening and closing of a pressure flow introducing passage of said pipe by suppressing a lever, and the dimensional relationship of said enlarged means is as follows:

$$l_0/d_2=1.25,\ \theta=6°,\ t/d_2=0.083.$$

30. A low noise level, pressure fluid spouting device according to claim 27, wherein said inlet means comprises one opening portion of a stepped hollow cylinder, said nozzle means comprises the smallest diameter portion of said stepped hollow cylinder, said smallest diameter portion comprising a throttled inner wall having a predetermined diameter and connected to said one opening portion, said enlarged means comprises the other opening portion of said stepped hollow cylinder comprising a first hollow cylinder portion having constant outer and inner diameters in the axial direction thereof and connected to said throttled inner wall of said nozzle means through a shoulder portion thereof; a second hollow cylinder portion having constant larger outer and inner diameters in the axial direction than those of said first hollow cylinder and connected to said inner wall of said first hollow cylinder portion through a shoulder portion thereof; and said tapered portion provided at the outlet side of said outer wall of said second hollow cylinder portion.

31. A low noise level, pressure fluid spouting device according to claim 30, wherein said inlet means has a threaded part at the inlet side of said outer wall thereof which engages with a threaded portion of a pressure flow introducing pipe of a gas nozzle having a valve means for controlling the opening and closing of a pressure flow introducing passage of said pipe by suppressing a lever, and the dimensional relationship of said enlarged means is as follows:

$$l_0/d_2=1.25,\ \theta=6°,\ t/d_2=0.083.$$

32. A low noise level, pressure fluid spouting device according to claim 28, further comprising an opening passage being opened at said throttled inner wall of said nozzle means and communicating with a liquid paint supply means through a conduit, and wherein said inlet means has a threaded part at the inlet side of said outer wall thereof which engages with a threaded portion of a pressure fluid introducing pipe of a paint spraying means having a valve means for controlling the opening and closing of a pressure flow introducing passage of said pipe by suppressing a lever, and the dimensional relationship of said enlarged means is as follows:

$$l_0/d_2=1.5,\ \theta=10°,\ t/d_2=0.10.$$

33. A low noise level, pressure fluid spouting device according to claim 27, wherein said nozzle means has a projected nozzle port extending into said enlarged passage of said first hollow cylindrical portion of said enlarged means with a predetermined length ($l_1$).

34. A low noise level, pressure fluid spouting device according to claim 33, wherein said inlet means has a threaded part at the inlet side of said outer wall thereof which engages with a threaded portion of a pressure flow introducing pipe of a paint spraying means having a valve means for controlling the opening and closing of a pressure flow introducing passage of said pipe by suppressing a lever, and the dimensional relationship of said enlarged means is as follows:

$$l_0/d_2=1.5,\ \theta=10°,\ t/d_2=0.10.$$

35. A low noise level, pressure fluid spouting device according to claim 11, wherein said inlet means comprises one opening portion of a stepped hollow cylinder, said nozzle means comprises the smallest diameter portion of said stepped hollow cylinder, said smallest diameter portion comprising a throttled inner wall having a predetermined diameter and connected to said one opening portion, said enlarged means comprises the other opening portion of said stepped hollow cylinder comprising a first hollow cylinder portion having constant outer and inner diameters in the axial direction thereof and connected to said throttled inner wall of said nozzle means through a curved shoulder portion thereof; a second hollow cylinder portion having constant larger outer and inner diameters in the axial direction than those of said first hollow cylinder and connected to said inner wall of said first hollow cylinder portion through a curved shoulder portion thereof; and said tapered portion being formed along a curved line which is radially inwardly offset with respect to a line joining the points of the inlet side and outlet side of said outer wall of said second hollow cylinder portion and has a predetermined angle $\theta$ to said enlarged passage of said second hollow cylinder portion at the exit thereof.

36. A low noise level, pressure fluid spouting device according to claim 35, wherein said inlet means is connected to a pressure exhausting supply source through an exhaust pipe, and the dimensional relationship of said enlarged means is as follows:

$$l_0/d_2=1.42,\ \theta=12°,\ t/d_2=0.071.$$

37. A low noise level, pressure fluid spouting device according to claim 11, wherein said inlet means comprises one opening portion of a stepped hollow cylinder, said nozzle means comprises the smallest diameter portion of said stepped hollow cylinder, said smallest diameter portion comprising a throttled inner wall having a predetermined diameter and connected to said one opening portion, said enlarged means comprises the other opening portion of said stepped hollow cylinder comprising a first hollow cylinder portion having constant outer and inner diameters in the axial direction and connected to said throttled inner wall of said nozzle means through a stepped shoulder portion thereof, and a second hollow cylinder portion having constant larger outer and inner diameters in the axial direction than those of said first hollow cylinder and connected to said inner wall of said first hollow cylinder portion through a stepped shoulder portion thereof, and said tapered portion being formed along a curved line which is radially inwardly offset with respect to a line joining the points of the inlet side and outlet side of said outer wall of said second hollow cylinder portion and has a predetermined angle ($\theta$) to said enlarged passage of said second hollow cylinder portion at the exit thereof.

38. A low noise level, pressure fluid spouting device according to claim 37, wherein said inlet means is connected to a pressure exhausting supply source through an exhaust pipe, and the dimensional relationship of said enlarged means is as follows:

$$l_0/d_2=1.42,\ \theta=12°,\ t/d_2=0.071.$$

39. A low noise level, pressure fluid spouting device according to claim 4, wherein said inner wall of said enlarged means is formed along a straight line having a predetermined angle to the axis of said enlarged means, and said tapered portion of outer wall of said enlarged means is formed along a straight line having a predetermined angle to said inner wall thereof.

40. A low noise level, pressure fluid spouting device according to claim 9, wherein said inner wall of said enlarged means comprises two inner walls which are axially provided and respectively connected, the diameter of the inlet side of one inner wall being constant in the axial direction thereof, and the diameter of the outlet side of the other inner wall being gradually increased towards the exit thereof in the axial direction, said tapered portion of said outer wall of said enlarged means is formed along a curved line joining the points of the inlet side and outlet side of said outer wall of said enlarged means and has a predetermined angle $\theta$ to said inner wall at the exit thereof, and said at least one opening passage comprises one opening passage being provided at said inlet side of one inner wall of said enlarged means.

41. A low noise level, pressure fluid spouting device according to claim 4, wherein said inner wall of said enlarged means is formed along a curved line which is radially inwardly offset with respect to a line joining the points of the inlet side and outlet side of said curved line, said tapered portion of said outer wall of said enlarged means is formed along a curved line having a predetermined angle $\theta$ to said inner wall of said enlarged means at the exit thereof.

42. A low noise level, pressure fluid spouting device according to claim 4, wherein, said inner wall of said enlarged means is formed along a curved line which is radially outwardly offset with respect to a line joining the points of the inlet side and outlet side of said curved line, said tapered portion of said outer wall of said enlarged means is formed along a straight line having a predetermined angle $\theta$ to said inner wall of said enlarged means at the exit thereof.

43. A low noise level, pressure fluid spouting device according to claim 4, wherein said inner wall of said enlarged means comprises two straight inner walls, said angle of said inlet side inner wall is smaller than that of said outlet side inner wall, said tapered portion of said outer wall of said enlarged means is formed along a straight line having a predetermined angle $\theta$ to said outlet side inner wall of said enlarged means.

44. A low noise level, pressure fluid spouting device according to claim 4, wherein said inner wall of said enlarged means comprises two straight inner walls, which are serially provided in the axial direction thereof, said angle of said inlet side inner wall is larger than that of said outlet side inner wall, said tapered portion of said outer wall of said enlarged means is formed along a straight line having a predetermined angle $\theta$ to said outlet side inner wall of said enlarged means.

45. A low noise level, pressure fluid spouting device according to claim 4, wherein said nozzle means and enlarged means comprise respectively two nozzle means and enlarged means parts, which are divided by a plate member inserted within said nozzle means and said enlarged means, said inner annular wall of said two enlarged means parts is formed along a straight line having predetermined angles to the axis of said two enlarged means parts, said tapered portion of said outer wall of said enlarged means is formed along a straight line having a predetermined angle $\theta$ to said inner annular wall of said enlarged means.

46. A low noise level, pressure fluid spouting device according to claim 4, wherein said nozzle means and enlarged means comprises respectively three nozzle means parts and three enlarged means parts, which are divided by two intermediate members provided within said nozzle means and enlarged means, said inner wall of said three enlarged means parts are formed along a straight line having a predetermined angles to the respective axis of said three enlarged means parts, said tapered portion of said outer wall of said enlarged means is formed along a straight line having a predetermined angle $\theta$ to said inner walls of said enlarged means.

47. A low noise level, pressure fluid spouting device according to claim 10, wherein said inlet means comprises one opening portion of a hollow cylinder having a constant outer diameter and different inner diameters, said nozzle means comprises an inlet tapered inner wall of said hollow cylinder connected to said one opening portion, a throttled inner wall having a predetermined diameter of said hollow cylinder connected to said inlet tapered inner wall, and an outlet tapered inner wall of said hollow cylinder connected to said throttled inner wall, said enlarged means comprises a small inner wall of said hollow cylinder having a constant diameter in the axial direction thereof, connected to said outlet inner wall of said nozzle means through a shoulder portion thereof;

said tapered portion being formed along a straight line having a predetermined angle to the axis of said enlarged means and being provided at the outlet side of said outer wall of said hollow cylinder.

* * * * *